US011701672B2

(12) United States Patent
Kah, Jr. et al.

(10) Patent No.: US 11,701,672 B2
(45) **Date of Patent: *Jul. 18, 2023**

(54) SPRINKLER HEAD NOZZLE ASSEMBLY WITH ADJUSTABLE ARC, FLOW RATE AND STREAM ANGLE

(71) Applicants: Carl L. C. Kah, Jr., North Palm Beach, FL (US); Carl L. C. Kah, III, North Palm Beach, FL (US)

(72) Inventors: Carl L. C. Kah, Jr., North Palm Beach, FL (US); Carl L. C. Kah, III, North Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/969,251

(22) Filed: May 2, 2018

(65) Prior Publication Data

US 2018/0250692 A1 Sep. 6, 2018

Related U.S. Application Data

(63) Continuation of application No. 14/626,463, filed on Feb. 19, 2015, now Pat. No. 9,981,276, which is a continuation of application No. 11/947,571, filed on Nov. 29, 2007, now Pat. No. 8,991,726.

(60) Provisional application No. 60/938,944, filed on May 18, 2007, provisional application No. 60/912,836, filed on Apr. 19, 2007.

(51) Int. Cl.

| | |
|---|---|
| ***B05B 1/32*** | (2006.01) |
| ***B05B 15/74*** | (2018.01) |
| ***B05B 3/00*** | (2006.01) |
| ***B05B 3/04*** | (2006.01) |
| ***B05B 1/26*** | (2006.01) |
| ***B05B 1/28*** | (2006.01) |
| ***B05B 1/30*** | (2006.01) |

(52) U.S. Cl.

CPC ..... *B05B 1/323* (2013.01); *B05B 1/265* (2013.01); *B05B 1/28* (2013.01); *B05B 1/3006* (2013.01); *B05B 3/005* (2013.01); *B05B 3/0486* (2013.01); *B05B 15/74* (2018.02)

(58) Field of Classification Search

CPC ..... B05B 1/323; B05B 1/265; B05B 1/28; B05B 1/3006; B05B 15/74; B05B 15/70; B05B 3/005; B05B 3/0486

USPC ..... 239/252

See application file for complete search history.

(56) References Cited

U.S. PATENT DOCUMENTS

| | | | | |
|---|---|---|---|---|
| 2,108,787 | A | 2/1938 | Coles | |
| 3,319,889 | A * | 5/1967 | Nelson | B05B 3/005 188/297 |
| 4,579,285 | A | 4/1986 | Hunter | |
| 4,660,766 | A | 4/1987 | Nelson et al. | |
| 4,898,332 | A | 2/1990 | Hunter et al. | |

(Continued)

*Primary Examiner* — Christopher S Kim

(74) *Attorney, Agent, or Firm* — Amster, Rothstein & Ebenstein LLP

(57) ABSTRACT

A sprinkler head nozzle assembly in accordance with an embodiment of the present invention includes a housing including an inlet for pressurize water and an outlet downstream of the inlet, a valve member, operable to extend and reduce an arcuate opening at the outlet of the housing, wherein the size of the arcuate opening indicates the arc of coverage of the sprinkler head nozzle assembly and a rotating distributor, mounted on a central shaft extending through the housing and the valve member, and operable to deflect a flow of water from the arcuate opening out of the nozzle assembly.

6 Claims, 55 Drawing Sheets

(56) References Cited

U.S. PATENT DOCUMENTS

| | | | |
|---|---|---|---|
| 4,932,590 | A | 6/1990 | Hunter |
| 5,058,806 | A | 10/1991 | Rupar |
| 5,148,990 | A | 9/1992 | Kah, Jr. |
| 5,322,223 | A | 6/1994 | Hadar |
| 5,355,979 | A | 10/1994 | Stephan |
| 5,556,036 | A | 9/1996 | Chase |
| 6,145,758 | A | 11/2000 | Ogi et al. |
| 6,230,450 | B1 | 5/2001 | Kuroda et al. |
| 6,464,052 | B1 | 10/2002 | Hsiao |
| 9,981,276 | B2 * | 5/2018 | Kah, Jr. ..... B05B 15/70 |
| 2002/0088875 | A1 | 7/2002 | Sirkin |
| 2002/0130202 | A1 | 9/2002 | Kah, Jr. et al. |
| 2002/0139868 | A1 | 10/2002 | Sesser et al. |
| 2003/0075620 | A1 | 4/2003 | Kah, Jr. |
| 2012/0273592 | A1 | 11/2012 | Zhang |

* cited by examiner

SPRINKLER HEAD NOZZLE ASSEMBLY WITH ADJUSTABLE ARC, FLOW RATE AND STREAM ANGLE

CROSS-REFERENCE TO RELATED APPLICATIONS

This application is a continuation of prior application Ser. No. 14/626,463, filed Feb. 19, 2015, which is a continuation of U.S. Ser. No. 11/947,571, filed Nov. 29, 2007, now U.S. Pat. No. 8,991,726, entitled SPRINKLER HEAD NOZZLE ASSEMBLY WITH ADJUSTABLE ARC, FLOW RATE AND STREAM ANGLE, which is a non-provisional that claims priority to and the benefit of U.S. Provisional Application Ser. No. 60/912,836, filed Apr. 19, 2007, entitled Adjustable ARC FLOW RATE AND STREAM ANGLE VISCOUS DAMPED STREAM ROTOR and U.S. Provisional Application Ser. No. 60/938,944, filed May 18, 2007, entitled LOW FLOW RATE FULLY ADJUSTABLE SPRINKLER NOZZLES, the entire contents of each of which are hereby incorporated by reference herein.

BACKGROUND

Field

The Present application relates to a sprinkler head nozzle assembly that includes a rotating distributor and provides for adjustment of arc of coverage, stream angle, range and flow rate.

Description of the Art

U.S. Pat. No. 4,867,378 discloses a sprinkler having an adjustable arc of coverage rotating nozzle with the arc of coverage being settable and indicated on the outside of the sprinkler. The market advantages for a sprinkler whose arc of coverage can be easily set are discussed in this patent, the entire disclosure of which is hereby incorporated herein by reference. The sprinkler of the '378 patent was for large area coverage, long thrown radius, oscillating sprinklers.

U.S. Pat. No. 5,148,990 discloses providing an adjustable and indicated arc of coverage for smaller and intermediate area of coverage sprinklers which can be fixed spray or rotating distributing heads that provide a plurality of streams for intermediate ranges and allow for adjustment of arc of coverage that automatically provides the same precipitation rate over the entire range of coverage. U.S. Pat. No. 6,814,304B discloses a speed control frictional brake that includes axial movement for varying flow rates and supply pressure to maintain a substantially constant rotational speed. U.S. Pat. No. 7,168,634 and U.S. Pat. No. D527,791 are also related patents covering other features of this type of sprinkler.

U.S. Pat. Nos. 4,815,662; 4,898,332; 4,986,474; 6,651,905 are reference patents that disclose adjustable arc and/or adjustable flow rate sprinklers where the distributor rotational speed is viscous damped. A significant shortcoming of these references is the need to provide several different sprinkler nozzle units or assemblies based on the desired arc of coverage range. For example, utilizing the technology of U.S. Pat. No. 6,651,905 it is necessary to provide three different nozzle assemblies in order to cover the full range of arc of coverage. That is one assembly provides a range of 90 degrees to 210 degrees, a second assembly allows for arc of coverage between 210 degrees and 270 degrees and a third assembly is required to allow for adjustment of the arc of coverage up to 360 degrees. Other related U.S. patents include U.S. Pat. Nos. 5,058,806; 5,288,022; 6,244521; 6,499,672; 6,651,905; 6,688,539; 6,736,332; 7,032,836; 4,842,201; 4,867,379; 4,898,332; 4,967,961.

U.S. Pat. No. 5,588,594 shows a stepped spiral arc settable spray nozzle where an arcuate slot valve is opened toward the center and the flow of water is directed upward onto a rotating distributor, and thereafter, deflected outward to provide coverage around the sprinkler.

U.S. Pat. No. 4,579,285 teaches the use of axially stepped spirals to provide an adjustable arcuate spray nozzle, but does not disclose or teach configuring the valve to be able to discharge directly onto a rotating deflector and still be able to adjust the arc of coverage. Also, there is no upstream proportional throttling provided in this reference which may result in undue pressure being applied to the arcuate valve for a desired range or flow rate.

U.S. Pat. No. 6,834,816, which is hereby incorporated by reference herein, discusses the benefits of a selected range arc settable spray nozzle with preset precipitation rate as set by the upstream proportional throttling valve which allows establishment of the upstream pressure to the arc settable valve which thus establishes a flow rate and resulting precipitation rate of the sprinkler as well as range of coverage due to its effect on discharge velocity from the sprinkler. The arc of coverage adjustment is coupled to an upstream flow throttling valve so that as the arc of coverage is adjusted, the opening of the upstream flow throttling valve is proportionally adjusted to maintain the precipitation rate and range of coverage substantially constant throughout the full range of arc of coverage settings of the valve arc settable stepped spiral discharge valve.

Accordingly, it would be beneficial to provide a sprinkler head nozzle assembly that avoids the problems noted above.

SUMMARY

A sprinkler head nozzle assembly in accordance with an embodiment of the present invention includes a housing including an inlet for pressurize water and outlet downstream of the inlet, a rotating arc adjustment ring mounted on the housing such that rotation of the arc adjustment ring extends and reduces an arcuate opening formed between the arc adjustment ring and the housing, wherein the size of the arcuate opening defines an arc of coverage provided by the nozzle assembly and a rotating distributor, mounted on a central shaft extending through the housing and the valve member and operable to deflect a flow of water extending through the housing and the arcuate opening outwardly from the nozzle assembly.

A sprinkler head nozzle assembly in accordance with an embodiment of the present invention includes a housing including an inlet for pressurize water and outlet downstream of the inlet, a valve member operable to extend and reduce an arcuate opening at the outlet of the housing, wherein the size of the arcuate opening indicates the arc of coverage of the sprinkler head nozzle assembly and a rotating distributor, mounted on a central shaft extending through the housing and the valve member and operable to deflect a flow of water from the arcuate opening outwardly from the nozzle assembly.

A sprinkler head nozzle assembly in accordance with an embodiment of the present invention includes a housing including an inlet for pressurized water and an outlet downstream of the inlet, a valve member operable to extend and reduce an arcuate opening at the outlet of the housing, wherein the size of the arcuate opening indicates the arc of coverage of the sprinkler head nozzle assembly and a rotating distributor, mounted on a threaded central shaft extending through the housing and the valve member, and operable to deflect a flow of water from the arcuate opening outwardly from the nozzle assembly.

A viscous brake assembly for use in a sprinkler head nozzle assembly with a rotating distributor head to limit the speed of the rotating distributor in accordance with an embodiment of the present invention includes a viscous braking chamber filled with a viscous liquid and formed in the distributor, a shaft extending through the viscous braking chamber and on which the distributor rotates, a braking disc connected to the shaft such that the distributor rotates relative to the shaft and the disc, the braking disc including a plurality of spiral vanes formed on an underside of the disc such that as the distributor rotates relative to the disc, the viscous liquid is drawn to the center of the disc and a plurality of recirculation openings formed through the disc and operable to allow the viscous fluid drawn to the center of the disc to pass through the disc and out the top of the disc. The flow of the viscous liquid in the braking chamber and through the disc increases the braking force of the viscous braking assembly.

A viscous brake assembly for use in a sprinkler head nozzle assembly with a rotating distributor head to limit the speed of the rotating distributor in accordance with another embodiment of the present invention includes a viscous braking chamber filled with a viscous liquid, a shaft extending through the viscous braking chamber and attached to the rotating distributor such that the shaft rotates with the distributor, a cylindrical rotor connected to the shaft to rotate with the shaft and including a plurality of spiral vanes formed on an side surface thereof that as the disc rotates with the shaft, the viscous liquid is pumped upward or downward along the rotor and a plurality of recirculation openings formed through the rotor and operable to allow the viscous pumped upward or downward along the rotor to pass through the rotor and out the opposite end thereof. The flow of the viscous liquid in the braking chamber and through the rotor increases the braking force of the viscous braking assembly.

A viscous brake assembly for use in a sprinkler head nozzle assembly with a rotating distributor to limit the speed of the rotating distributor in accordance with another embodiment of the present invention includes a viscous braking chamber filled with a viscous liquid and formed in the distributor, a shaft extending through the viscous braking chamber and on which the distributor rotates, a braking disc connected to the shaft such that the distributor rotates relative to the shaft and the braking disc, the braking disc including a recess formed in a bottom surface thereof and a wave washer spring positioned in the recess of the braking disc such that it is positioned between a bottom plate of the viscous braking chamber and the braking disc to set the distance between the disc and the bottom plate, wherein this distance changes depending on at least one of a flow rate and pressure of water directed at the distributor in the sprinkler head nozzle assembly such that a braking force provided by the viscous brake assembly varied depending on the flow rate and pressure.

A viscous brake assembly for use in a sprinkler head nozzle assembly with a rotating distributor to limit the speed of the rotating distributor in accordance with another embodiment of the present invention includes a viscous braking chamber filled with a viscous liquid, a shaft extending through the viscous braking chamber and attached to the rotating distributor such that the shaft rotates with the distributor, a tapered rotor connected to the shaft to rotate with the shaft and a wave washer spring positioned between a top of the tapered rotor and a top portion of the braking chamber to set a distance between the tapered rotor and the top portion of the braking chamber, wherein this distance changes depending on at least one of a flow rate and pressure of water directed at the distributor in the sprinkler head nozzle assembly such that a braking force provided by the viscous brake assembly varies with the flow rate and pressure.

DESCRIPTION OF THE EMBODIMENTS

Figure 1:
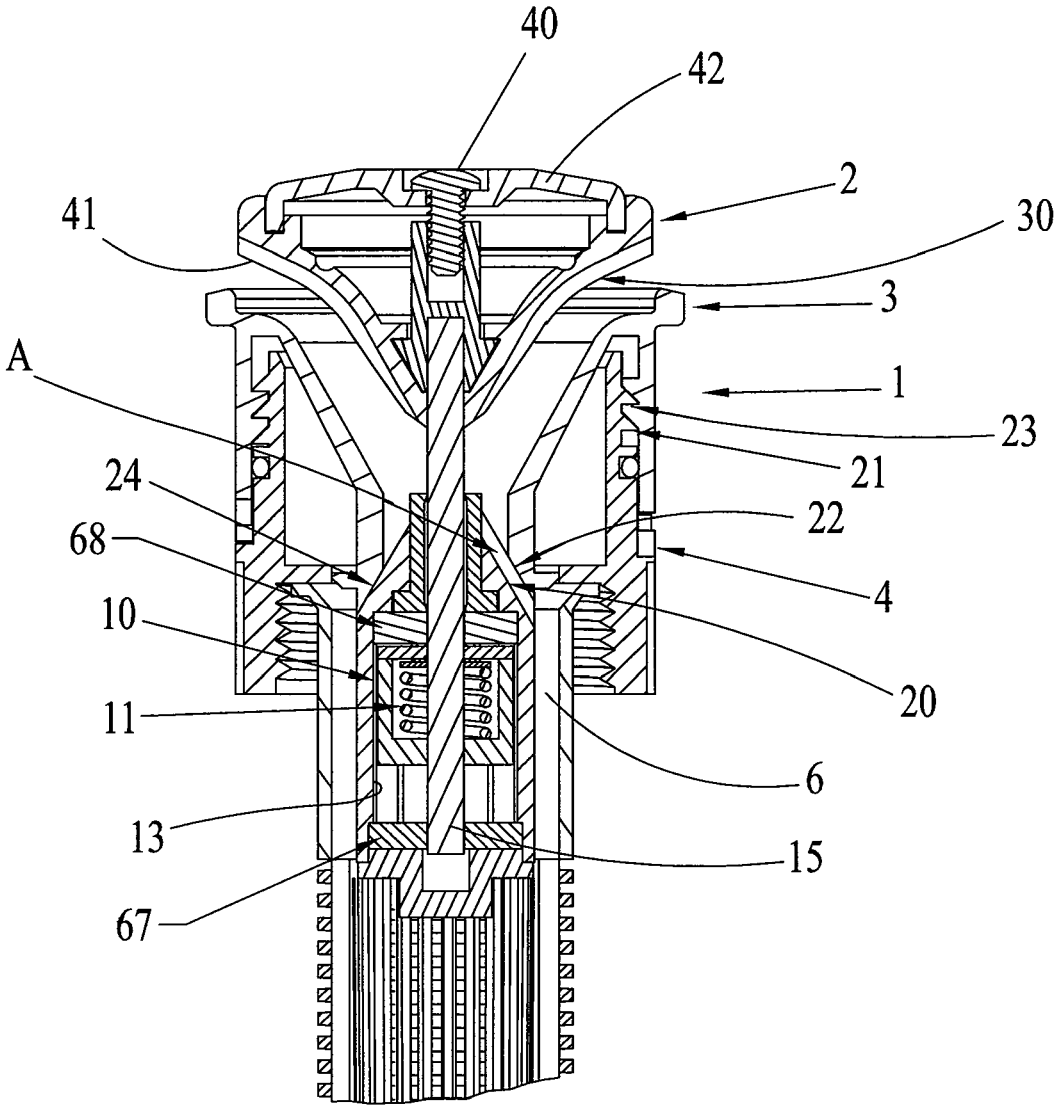
FIG. 1 shows a cross-sectional side elevation view of a sprinkler head nozzle assembly in accordance with an embodiment of the present invention.

A fully adjustable arc of coverage rotating distributor sprinkler head nozzle assembly 1 in accordance with an embodiment of the present invention is shown in cross-section in FIG. 1 in its raised, operating position. The nozzle assembly 1 preferably includes a nozzle assembly housing 4 with an adjustable arcuate opening A at a top thereof. An arc adjustment ring 3 is connected to the top of the housing and rotates to adjust the arcuate opening A, and thus, set the arc of coverage of the sprinkler in which the nozzle assembly 1 is used. Specifically, the arcuate opening A is shown in a partially open position based on the interaction of stepped spiral elements at 20 and 22. As can be seen on the left side of FIG. 1, however, the elements 20, 22 interact to close the opening A as indicated by reference numeral 24. The opening A has an arcuate length that can be adjusted to set the arc of coverage of the nozzle assembly. The size of the arcuate opening A is based on the interaction of a first axially stepped spiral element, or surface 20, which is part of the housing 4, and the second axially stepped spiral element, or surface 22, which is part of an arc adjustment ring 3, which is threaded onto the housing outer circumference 21 such that it is movable axially with respect to the housing as it rotated to set the arc of coverage. The threaded portion has the same pitch as the stepped spiral elements 20 and 22 that form the opening to maintain sealing engagement of these interacting valve sealing surfaces. The upper spiral surface 22 is shown in FIG. 1 which is a cross-sectional view of nozzle assembly and in FIG. 7 where the upper spiral valving surface, or element 22 can be seen in the perspective view of the arc adjustment ring 3. The housing spiral valving surface, or element 20 can be seen in FIG. 8 which is an illustration of the inside of the nozzle housing 4. The mating arc adjustment ring spiraled valve surface 22 can remain in contact with the stepped upwardly spiraled surface 20 of the housing 4 as the arc adjustment ring is rotated to provide an arcuate adjustable slot orifice opening angled upwardly toward the center and directed onto the rotatable stream deflector, or distributor 2. The axial position of the internal thread 23 of the arc adjustment ring and the axial positioning of the external thread 21 on the housing 4 is established to provide a squeeze sealing rotatable slip fit between stepped spiral valving surfaces 20 and 22. The surface 19 of the stepped spiral valve surface 22 of the arc adjustment ring 3 is the adjustable end of the arcuate valve opening slot directed up onto the rotating stream deflector and the surface 18 is the fixed other end of the adjustable arcuate slot provided by the housing spiral valving surface 20.

In operation, when the ring 3 is rotated relative to the housing 4, the arcuate length of the opening A changes and the arc of coverage is set. When the ring is rotated to increase the length of the opening A which increases the arc of coverage, thus increasing flow to provide the larger arc of coverage, the arcuate slot area increases in directly proportion to the increased arc of coverage and automatically provides uniform precipitation over the as adjusted arc of coverage, i.e. a matched precipitation sprinkler nozzle assembly. While not specifically illustrated in FIG. 7, the nozzle assembly housing 4 preferably is connected to a supply of water, and thus, has an inlet such that water flows through the housing, 4, the ring 3, the arcuate opening A and is deflected off the distributor 2 outwardly from the nozzle assembly 1. A nozzle assembly is shown mounted on a riser in a sprinkler body for connection to a supply of water in FIG. 43, for example.

The opening A formed between the spiral elements 20, 22 is preferably angled inwardly and upwardly against the rotating distributor 2, which then directs the water from the opening A outwardly from the rotary sprinkler head nozzle assembly 1.

Figure 13:
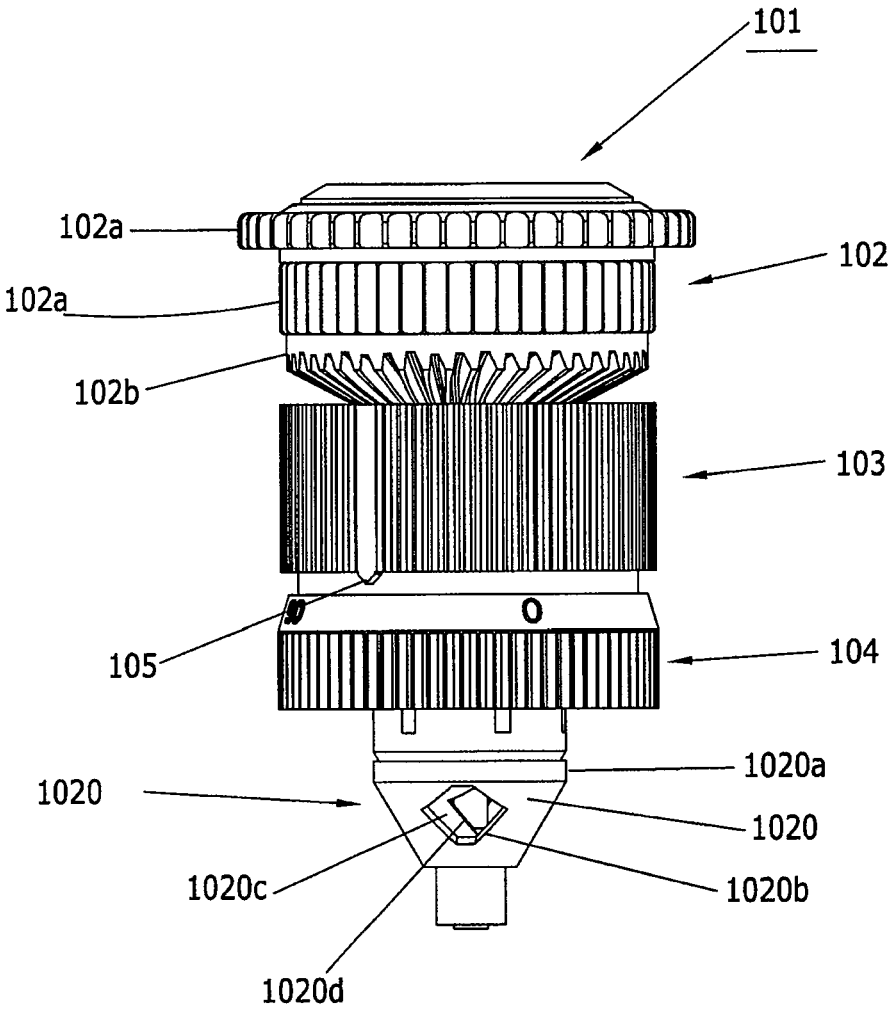
FIG. 13 is a perspective view of the nozzle assembly of FIG. 11 with the filter removed showing the upstream adjustable flow throttling valve.

In a preferred embodiment, the flow of water is collected into slots 30, which spiral outwardly from the underside of the rotatable distributor 2, causing the distributor to rotate. The speed at which the distributor 2 rotates is controlled by a viscous break assembly 10 that is preferably housed in an interior cavity 13 of the housing 4. A deflector retraction spring can also be incorporated to bias the distributor to the closed position as shown in FIG. 13, for example.

In a preferred embodiment, the distributor 2 is also retractable to prevent mechanical damage and to provide protection against dirt that may clog the output. In particular, a retraction spring mechanism 11 is preferably provided with the viscous break assembly 10 in the housing 4.

The rotating distributor 2 may be molded of an elastomeric material so that its outer circumference 41 can be deflected downward by a range control center screw 40, for example, in the top cap 42 of the rotary distributor 2 to lower or adjust the stream exit angles of the streams of water that are directed out of the nozzle assembly 1 by the distributor 2.

Figure 2:
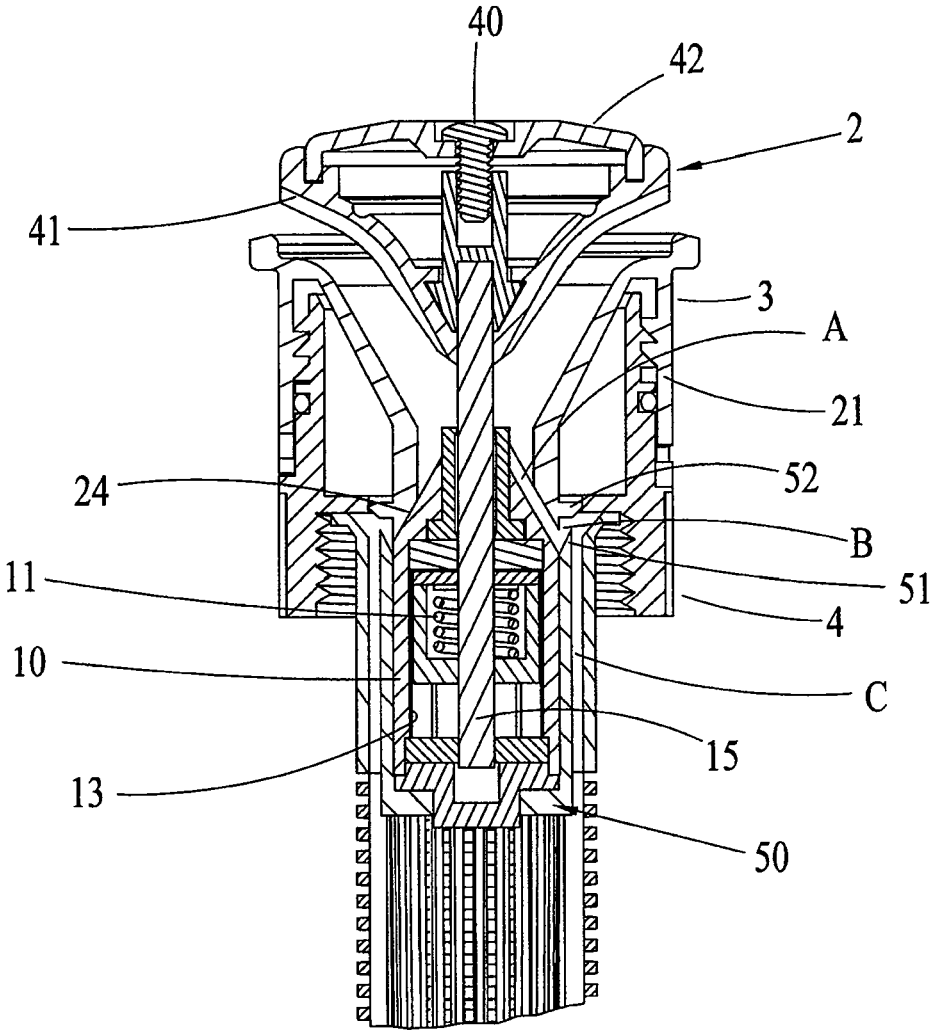
FIG. 2 shows a cross-sectional side elevation view of the sprinkler head nozzle assembly of FIG. 1 including an upstream flow restrictor insert in accordance with another embodiment of the present invention.
Figure 2A:
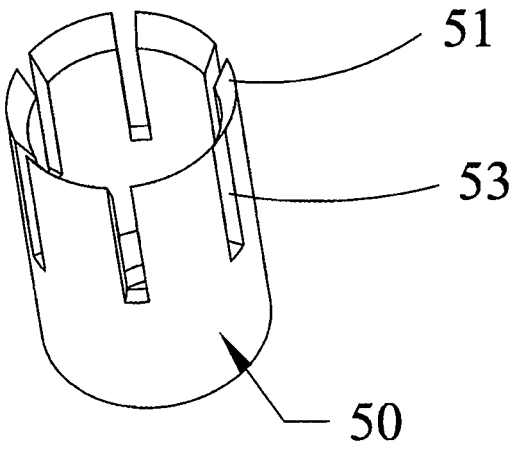
FIG. 2A shows the upstream flow restrictor for establishing a different range or precipitation rate removed from the nozzle assembly.

A restrictor insert 50, illustrated in FIG. 2, for example, may be inserted from the bottom of the sprinkler assembly 1 to provide flow restriction up-stream of the opening A to reduce the flow rate to that required for a particular range. For example, where the normal flow rate of the sprinkler head assembly 1 would allow for a range of 25 feet, the insert 50 may be provided to restrict the flow to that appropriate for a range of 12 feet, for example. In addition, a secondary proportional throttling ring 52 (See FIGS. 2 and 7, for example) may also be provided on the ring 3 such that it also movable up and down by the threads 21 on the housing 4 as the opening formed by the spiral elements 20, 22 is adjusted. The secondary proportional throttling ring 52 acting in conjunction with the top edge 51 of the range/flow set restrictor 50 reduces the pressure that is applied to the arc adjustable valve elements 20, 22 which direct the flow of water upwardly onto the rotating distributor 2 to reduce its exit velocity, range and flow rate. An exemplary embodiment of an insertable flow restrictor for a particular range is shown by itself in FIG. 2A. These inserts can be provided for a selection of desired ranges and inserted into the existing nozzle assembly to provide a desired range of coverage at the same precipitation rate throughout its fully settable arc of coverage.

The insert 50, by it interaction with the secondary ring 52 automatically provides a proportionally adjustable upstream throttling area B (See FIG. 2) for the arcuate opening A formed by the interaction of spiral elements 20, 22 as it is changed to achieve a different arcuate coverage for the sprinkler head nozzle assembly 1.

In a preferred embodiment, the nozzle assembly 1, for example, may be provided with a pre-set stream elevation exit angle and proportional throttled flow rate for matched precipitation at a desired range of coverage, if desired. That is, these features may be set in advance.

Figure 3:
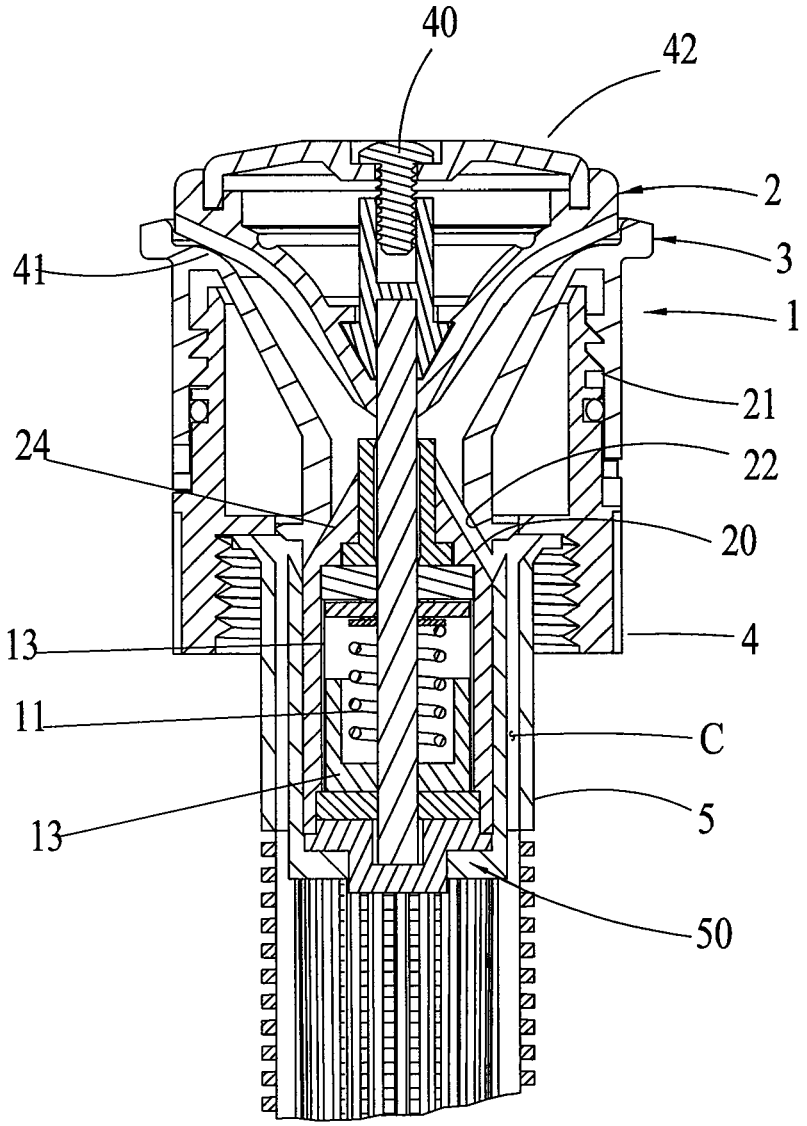
FIG. 3 shows a cross-sectional side elevation view of the sprinkler head nozzle assembly of FIG. 2 in a closed, deflector retracted position.

The rotary sprinkler head nozzle assembly 1 of the present application is thus very flexible since the same basic design may be modified to provide for ranges of 10 feet, 12 feet, 15 feet, 25 feet and 30 feet, etc. while the same precipitation rate is maintained. Alternatively, the assembly can be modified in the field using upstream pressure drop flow control inserts, such as restrictor insert 50 for example, to provide the desired precipitation rate and range. Further, as noted above, the distributor stream elevation angle is also easily adjusted via the screw 42, for example, to compress the outer circumference of the elastomeric deflector downwardly, or allowing it to spring back upwardly to provide more range at lower stream velocities and flow rates. FIG. 3 illustrates a cross-sectional side elevation view of the same sprinkler head as in FIG. 2, but with the rotating distributor 2 in its retracted, closed, position.

Figure 4:
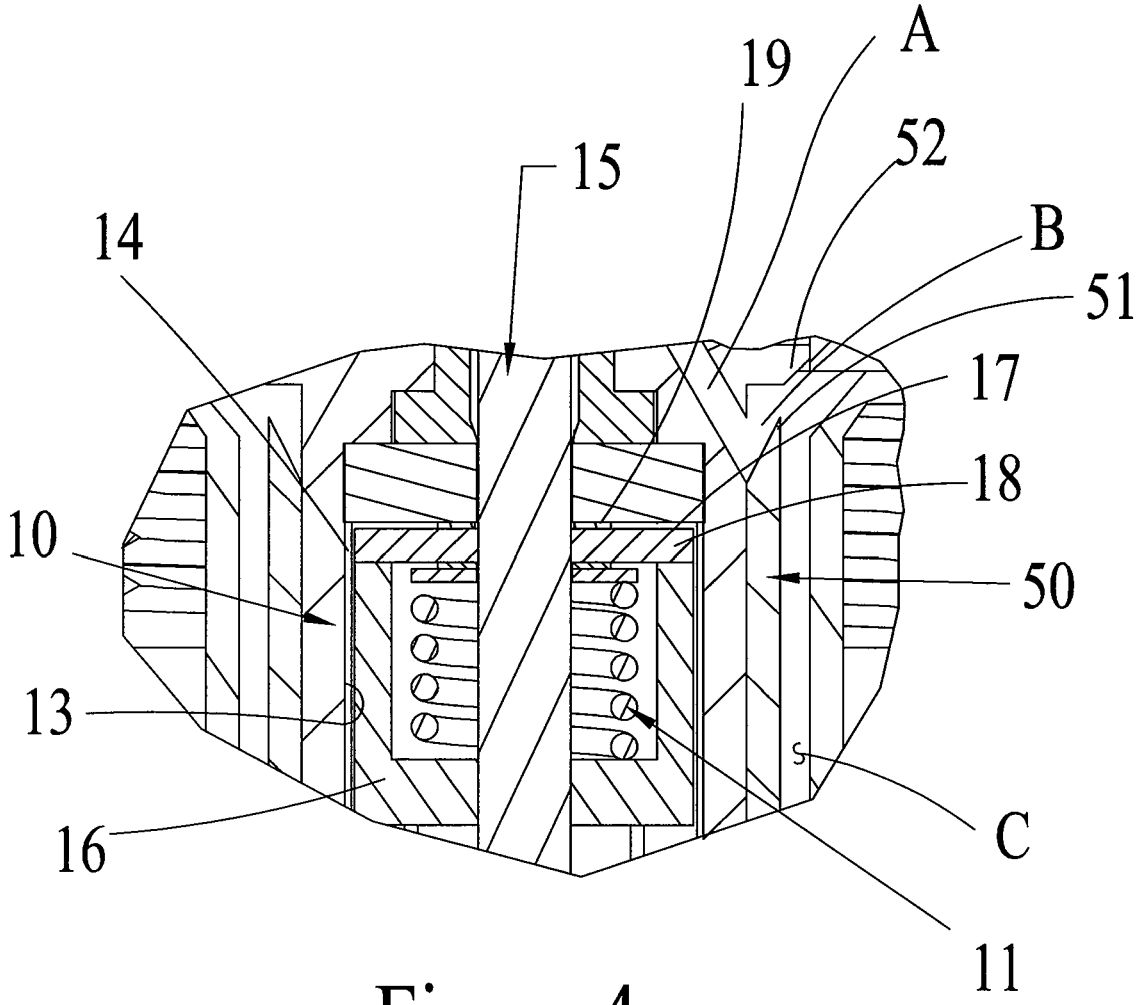
FIG. 4 shows an expanded view of the viscous dampening rotor area of the sprinkler head nozzle assembly of FIG. 1.

FIG. 4 illustrates an expanded view of the viscous break assembly 10 positioned in the cavity 13 with the retraction spring assembly 11 shown in the fully compressed position. In this case, the distributor 2 is forced up into its operating position by the water flow striking the distributor 2 such that the spring 11 is compressed.

As can be seen in FIG. 4, the rotor 16, is preferably press fitted onto the shaft 15 which is rotated by the stream reaction forces exerted when the spiraling flow stream exits the outer circumference of the rotary stream distributor 2. Viscous dampening occurs between the rotor 16 as it is turned by the shaft 15 and the inside wall of the cavity 13. Further dampening occurs between the rotor 16 and the top of the chamber at 17, or more specifically, between the dampening plate 18 which turns with the rotor 16 and the top of the chamber 17 when the retraction spring 11 is fully compressed. The thickness of the spacer and rotation shaft washer 19 in combination with the grease viscosity determines how much viscous dampening occurs at the top surface of the viscous dampening cavity 13 in concert with that along the sides of the cavity 13.

As the flow rate is reduced for a reduced arc of coverage, for example, the spring 11 is able to lessen the force between rotor 16 and dampening disc 18 so that there is less dampening at the top area of the cavity 13 and only the dampening area along the sides of the rotor acting against the reduced area of rib in the inside diameter of chamber 13 plays a role in dampening.

Figure 5:
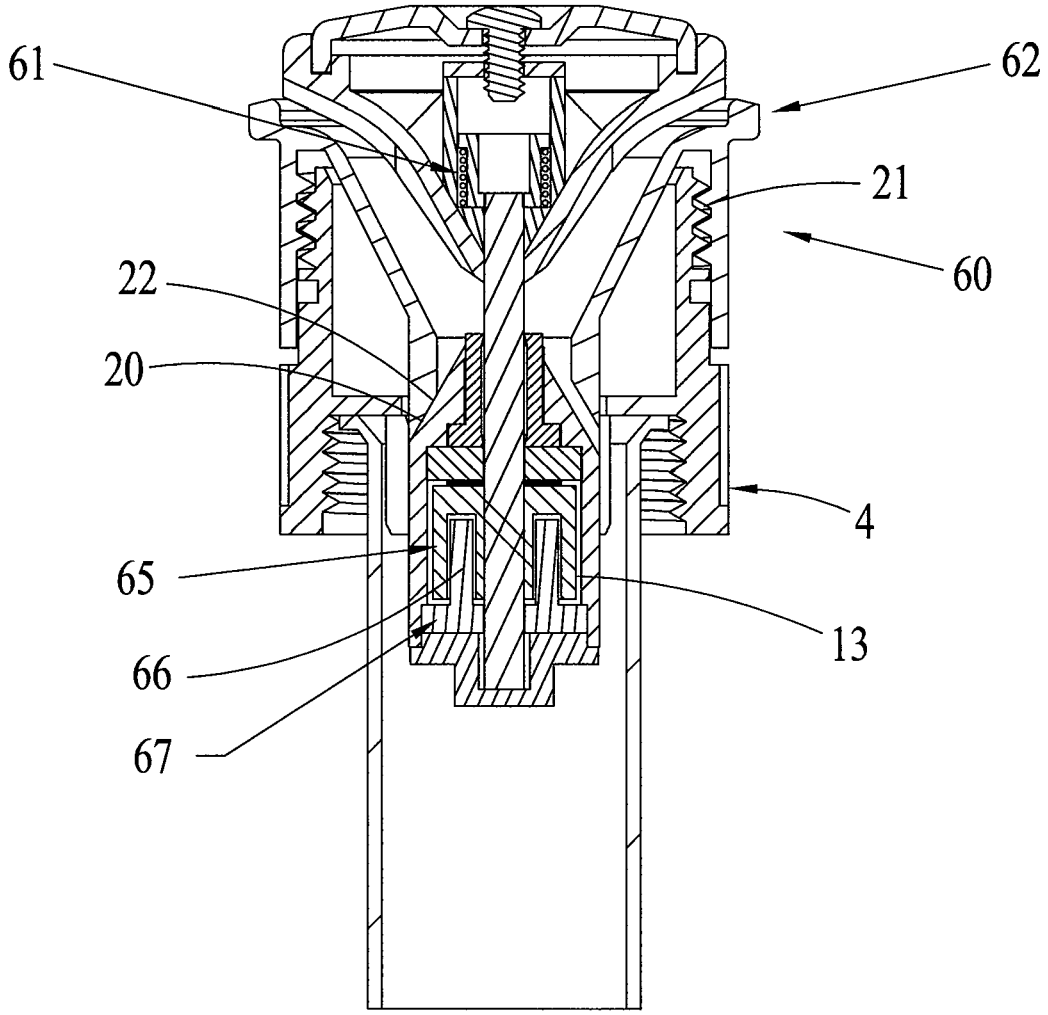
FIG. 5 shows a cross-sectional side elevation view of a sprinkler head nozzle assembly in accordance with an alternative embodiment of the present invention where the deflector retraction spring is housed in the rotating deflector housing.

FIG. 5 illustrates a cross-sectional side elevation view of an alternative embodiment of a nozzle assembly 60 in accordance with the present invention. The nozzle assembly 60 is similar to that of FIG. 1, but preferably includes a retractable distributor 62 whose retraction spring assembly 61 is housed in the distributor member rather than in the cavity 13.

Additional rotational speed viscous damping may be provided by having an internal cylindrical damping surface area 66 standing up from the lower shaft bearing 67 as shown in FIG. 5.

Figure 6:
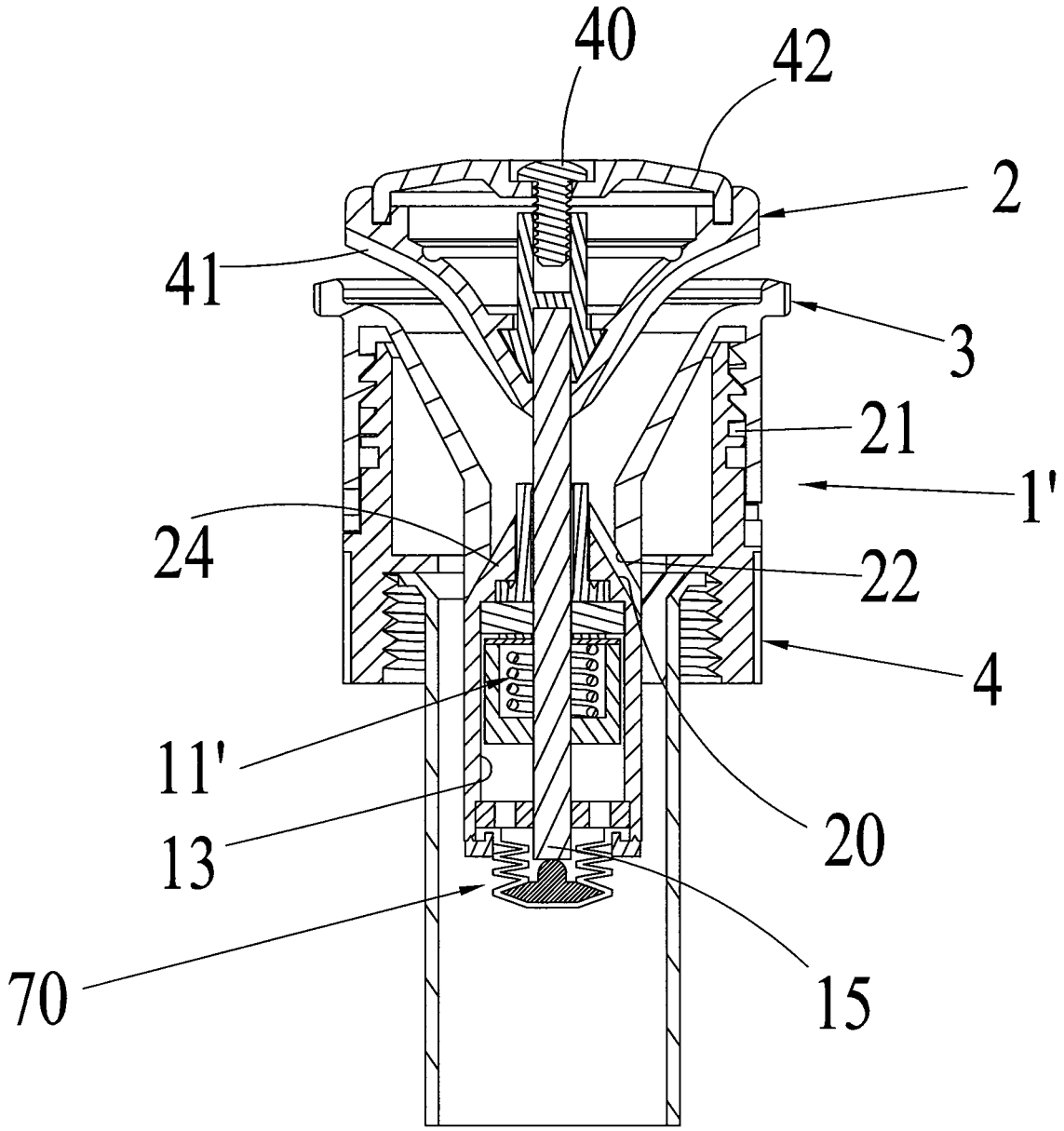
FIG. 6 shows a cross-sectional elevation view of a sprinkler head nozzle assembly in accordance with another embodiment of the present invention with a deflector extension force being provided or supplemented by a separate pressure activated member.

FIG. 6 shows a cross-sectional view of a nozzle assembly $\mathbf{1}^1$ with a stronger retraction spring assembly $\mathbf{11}^1$ for the distributor 2 housed in the viscous dampening cavity 13 and a pressure assist bellow member 70 provided at the bottom of the assembly $\mathbf{1}^1$ to aid in raising the deflector 2 up against the stronger retraction spring assembly $\mathbf{11}^1$ into its operating position as shown. Otherwise, the assembly $\mathbf{1}^1$ operates in substantially the same manner as described in FIGS. 1-3.

Figure 7:
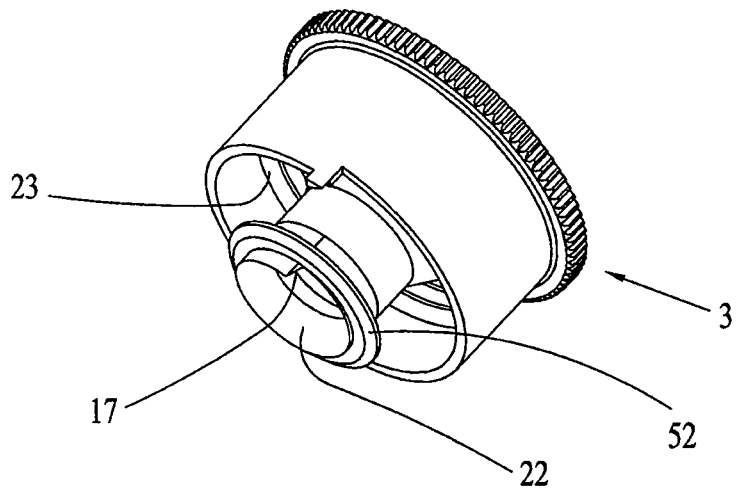
FIG. 7 shows a three-dimensional view of the bottom of an arc adjustment ring of the sprinkler head nozzle assembly of FIG. 1.
Figure 8:
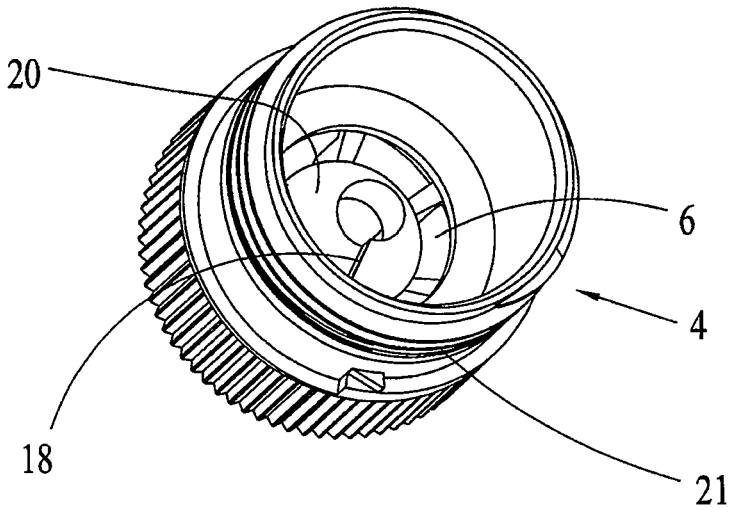
FIG. 8 shows a three-dimensional view of the inside of the nozzle assembly housing of the sprinkler head nozzle assembly of FIG. 1.
Figure 9:
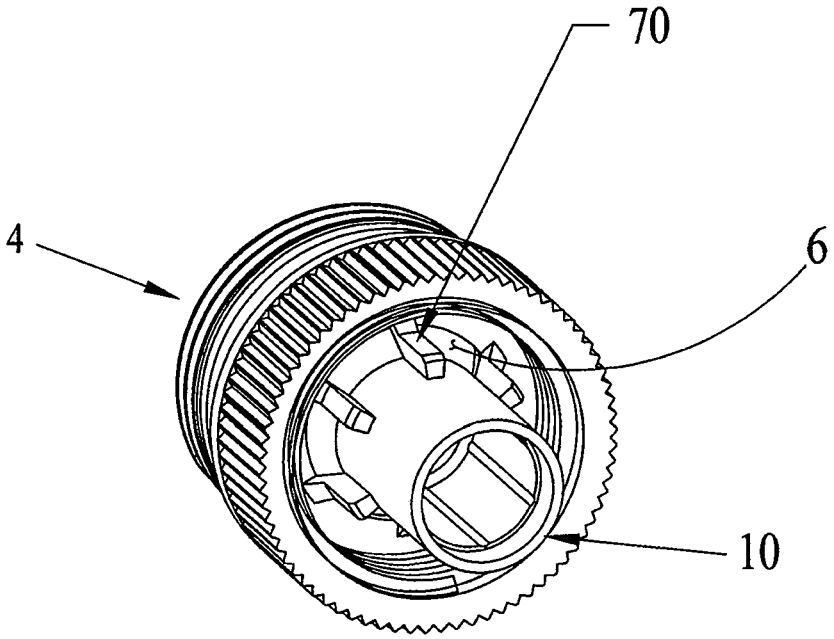
FIG. 9 shows a three dimensional view of the bottom of the housing of FIG. 8.
Figure 10:
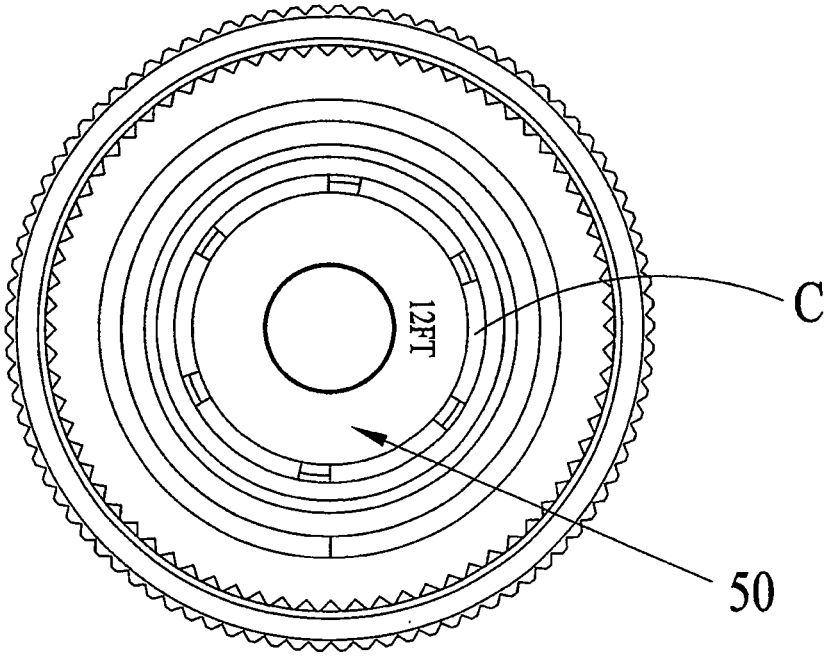
FIG. 10 is a view of the bottom of the nozzle assembly of FIG. 2 showing the flow restrictor insert.

FIG. 7 illustrates a more detailed view of the arc adjustment ring 3 of the assembly 1 illustrated in FIGS. 1-6. FIG. 7 provides a clearer view of the stepped spiral element, or surface 22 which interacts with the stepped spiral element, or surface 20 to provide the opening A. FIG. 8 is a more detailed illustration of the housing 4 of the assembly 1 illustrated in FIGS. 1-6. In FIG. 8, the lower stepped spiral element 20 can be seen more clearly. FIG. 9 illustrates a bottom view of the housing 4 in which the viscous brake housing 10 is clearly visible. FIG. 10 illustrates a bottom view of the assembly 1 illustrating the restrictor insert 50 which in this particular embodiment is inserted to restrict flow through the nozzle assembly 1 to provide a matched precipitation flow rate to correspond to a range of 12 feet, for example. FIG. 2 shows a cross-section view of the nozzle assembly with this matched precipitation range setting upstream restrictor installed.

Simple adjustment of the ring 3 of the assemblies discussed above thus allows for both setting the arc of coverage and adjusting flow as appropriate for the adjusted arc of coverage because of the interaction of surface 51 of insert 50 with surface 52 of the arc adjustment ring 3 to provide automatically changeable upstream proportional flow throttling to the arcuate adjustable valve for the new desired range flow rate to provide the desired precipitation rate, i.e. less range, less flow rate required for the same precipitation rate as when the nozzle assembly covered a greater range.

Figure 11:
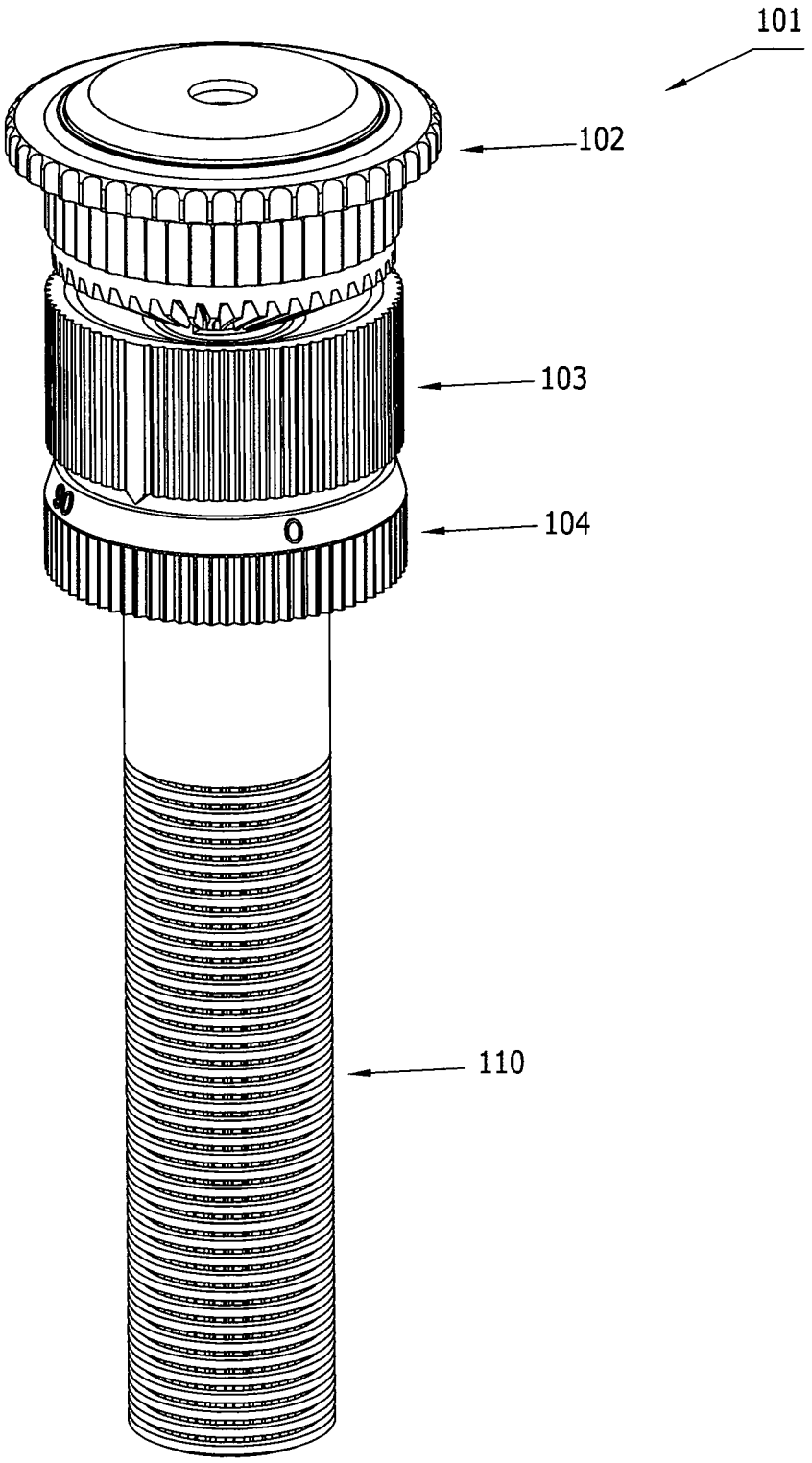
FIG. 11 shows a perspective view of a sprinkler head nozzle assembly in accordance with another embodiment of the present invention.
Figure 43:
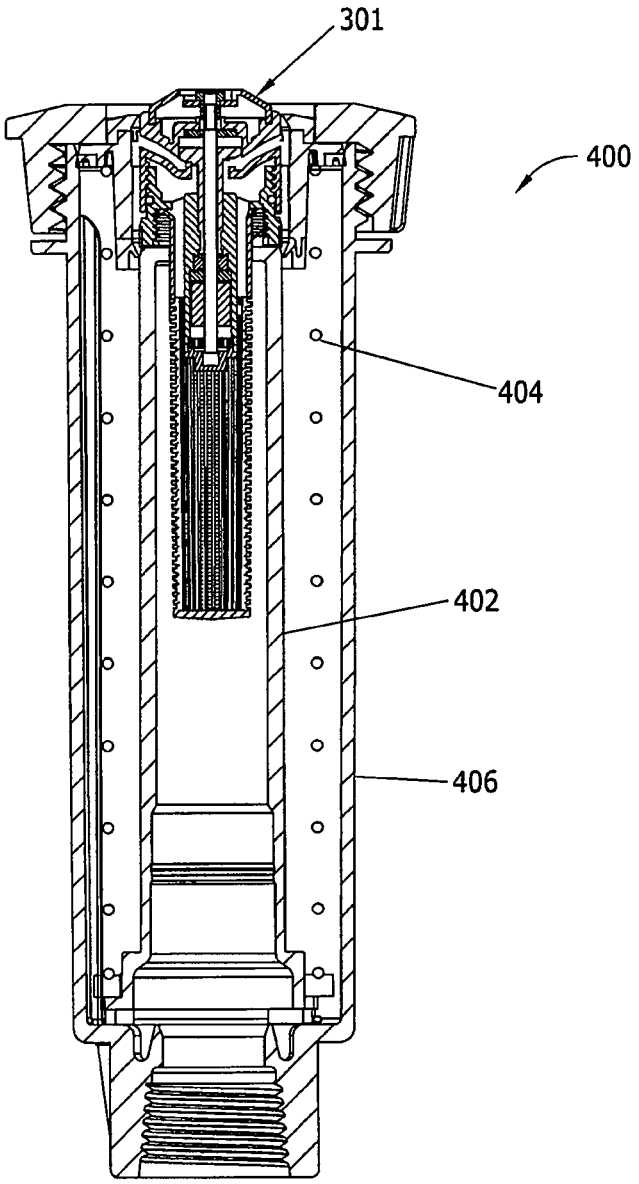
FIG. 43 is a cross section of a sprinkler including a nozzle assembly in accordance with an embodiment of the present application attached thereto.

An alternative embodiment of a sprinkler head nozzle assembly 101 in accordance with the present invention is described with reference to FIG. 11. FIG. 11 shows a perspective view of a nozzle assembly 101 that includes arc of coverage flow control, stream exit elevation angle control and an indication of the arc of coverage that is set. In addition, a filter 110 may be provided as well which typically fits in a sprinkler riser when the assembly 101 is attached to a sprinkler, as shown in FIG. 43. In a preferred embodiment, the filter 110 is pressed onto ribs (not shown) inside the nozzle assembly housing 104. The arc adjustment ring 103 is rotatable to adjust arc of coverage and flow.

Figure 12:
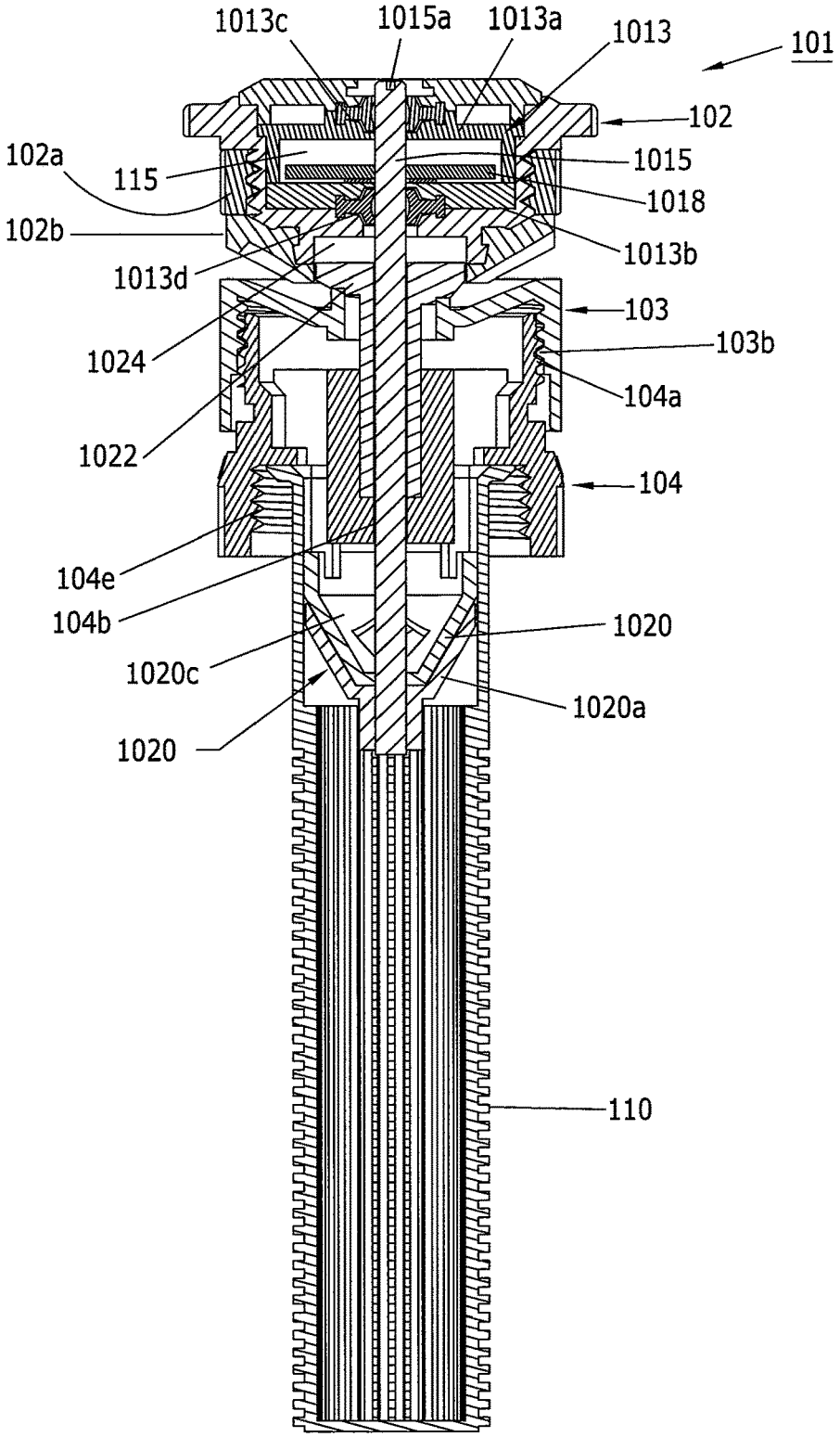
FIG. 12 shows a cross sectional view of the nozzle assembly of FIG. 11.
Figure 22:
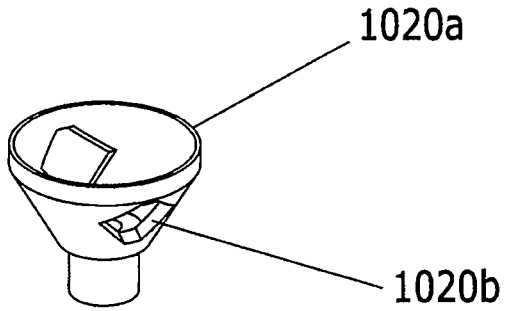
FIG. 22 shows a perspective view of an upstream throttling valve member of the nozzle assembly of FIGS. 11-13.
Figure 23:
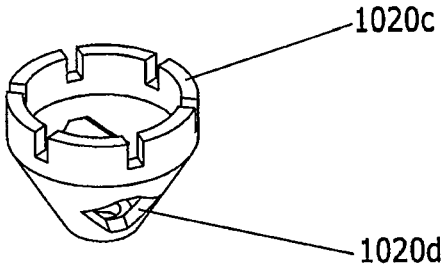
FIG. 23 is a perspective view of the stationary portion of the upstream throttling valve of FIG. 22.

In operation, the housing 104 remains stationary and the arc adjustment ring 103 is screwed onto the housing in substantially the same way ring 3 is connected to housing 4 in FIG. 1, for example. An upper valve member 1022 (See FIG. 17, for example) is positioned in the central opening of the arc adjustment ring 3 and down into the central opening 104*a* (See FIG. 14, for example) of the housing 104. The stepped spiral element 1022*b* (FIG. 17) of the upper valve member 1022 interacts with the lower stepped spiral element 103*a* of the ring 103 (See FIG. 15, for example) to form an arcuate opening A (See FIGS. 19-20, for example) for the flow of water. The upper valve element 1022 is rotationally fixed to the housing 104 such that rotation of the ring 103 adjusts the size of the arcuate opening A in a manner similar to that described above, such that the arc of coverage for a sprinkler using the nozzle assembly 101 is set by the ring 103. In this case the arc adjustment ring 103 is threaded to move downwardly to open the arcuate slot FIG. 12 illustrates a cross sectional view of the nozzle assembly 101 of FIG. 11. The rotational speed of the rotating distributor 102 is viscous damped by a disc member 1018 that is press-fitted onto a small diameter axial shaft 1015 which is press-fitted through the center mounting hole 104*b* in the nozzle assembly housing 104 such that the shaft tightly fits into the housing 104 to resist rotation. Thus, as the distributor 102 rotates, damping occurs in the viscous damping chamber 1013 which is preferably mounted in the distributor in this embodiment. The shaft 1015, however, can be turned from the top using the screw driver slot 1015*a*. As illustrated, the bottom of the shaft 1015 is connected to the cone shaped external throttle valve member 1020*a* such that the upstream throttle valve member 1020*a* can turn with the shaft 1015 by overcoming the house press-fit friction. FIGS. 22-23 provide a more detailed illustration of the external throttle valve member 1020*a* and the internal throttle valve member 1020*c*. The external throttle valve member 1020*a* preferably includes diamond shaped flow parts 1020*b* which move with the external member when the member 1020*a* is rotated with the shaft 1015. These flow parts 1020*b* thus can be moved into and out of alignment with corresponding diamond shaped openings 1020*d* of the stationary internal throttle valve member 1020*c* (see FIG. 23) which is preferably connected to bottom of the housing 104. Adjusting the alignment of the flow parts 1020*b* with the openings 1020*c* can be used to reduce the flow into the housing 104. Further, the unique diamond shape allows for the concentration of the flow area into a single concentrated opening which has less sensitivity to dirt and clogging. The throttle valve 1020, including the external element 1020*a* and the internal element 1020*c*, thus helps prevent clogging and also provides upstream throttling which reduces pressure on the downstream components.

The viscous chamber 1013 preferably has a shaft bearing plate above 1013*a* and below 1013*b* press fitted into the distributor housing 102*a* with a motion allowance axial displacement space for a shaft stationary damping disc 1018, indicated by reference numeral 115 FIG. 12 as well as a shaft seal at the top 1013*c* and bottom 1013*d* of the chamber 1013 to the outside to prevent loss of viscous damping fluid or dirt getting into the chamber.

The shaft seals 1013*c*, 1013*d* are shown of a larger diameter to provide some of the wall diaphragm area to allow axial movement of the distributor 102 and also to allow for some internal volume change without the need to vent to the outside.

The distributor 102 preferably is positioned such that an axial motion space 1024 is provided to allow for the upper valve element 1022 to move in and out to allow the distributor 102 to be forced down to touch the top surface of the arc adjustment ring 103 such that the ring carries any excessive axial loads. These loads are also spread to the threads 103*b* and 104*a* connecting the ring 103 to the housing 104. The pitch of these threads is the same as the axial step of the stepped spiral elements 103*a*, 1022*b* that form the arcuate opening A. The internal thread of the housing 104*e* for attaching the nozzle assembly 1 to a sprinkler riser (not shown) can also be seen in FIG. 12.

FIG. 13 illustrates a perspective view of the nozzle assembly 101 with the filter 110 removed such that the throttle valve 1020 is clearly visible. The upstream flow-throttle valve 1020 on the bottom is shown partially closed. As noted above, this is preferably achieved by rotating the shaft 1015 connected to the external throttling valve element 1020*a* to open and close the flow parts 1020*b* relative to the openings 1020*d*.

The arc adjustment ring 103 preferably includes a pointer 105 that identifies the arc of coverage that the nozzle assembly 101 has been adjusted to. That is, the pointer 105 points to the coverage angle to which the arcuate opening A has been set. Angle values are preferably indicated on the outside of the housing 104.

A stream elevation adjustment ring 102*a* is provided around the outside wall of the distributor 102 and contacts a flexible hard rubber grooved stream deflector surface 102*b* which can be deflected to change the stream exit elevation angles for range control or to decrease sensitivity to wind conditions, for example. The connection of the stream elevation adjustment ring 102*a* with the deflector 102*b* is shown more clearly in the cross section of FIG. 12.

Figure 14:
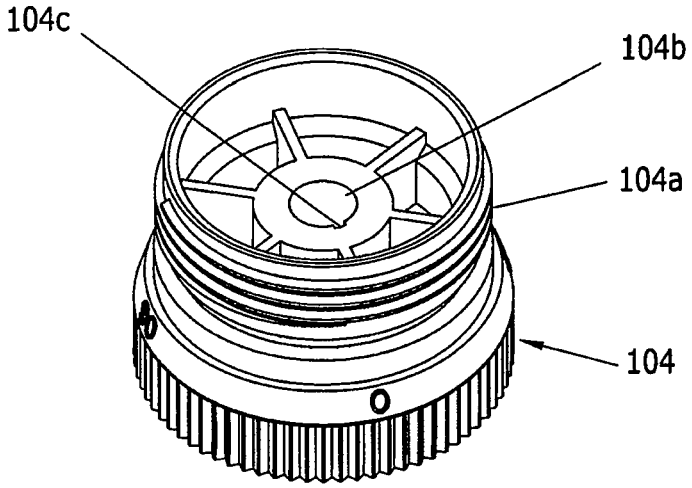
FIG. 14 shows a perspective view of the nozzle assembly housing of the nozzle assembly of FIGS. 11-13.

FIG. 14 provides a more detailed view of the nozzle assembly housing 104 including the thread 104*a* around the upper circumference thereof shown for mating with the arc adjustment ring 103. Also the center hole 104*b* where the matching upper valve element 1022 is pressed into and rotationally locked by the key 1022*a* (See FIG. 17, for example) in the key way 104*c*. An indication of the arc of coverage that is set is provided around the circumference of the lower end of the housing 104. Further, the circumference is preferably serrated to allow for holding the body housing 104 while the ring 103 is rotated to adjust the arc of coverage.

Figure 15:
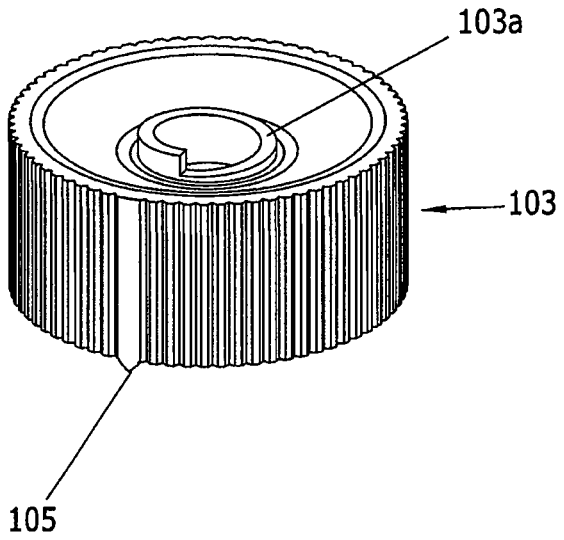
FIG. 15 shows a perspective view of a rotatable arc adjustment ring of the nozzle assembly in FIGS. 11-13.

FIG. 15 is a more detailed view of the arc adjustment ring 103 which the shows the serration around the outside of the ring 103 that allows for rotation of the ring. The lower stepped spiral element 103*a* on the top of the ring 103 cooperates with the stepped spiral element 1022*b* of the upper valve element 1022 to form the arcuate opening A.

Figure 16:
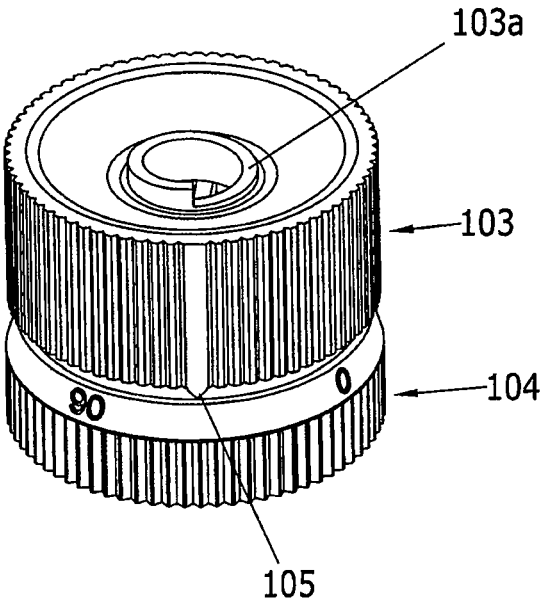
FIG. 16 shows a perspective view of the rotatable arc adjustment ring of FIG. 15 on the nozzle assembly housing of FIG. 14.

FIG. 16 shows a perspective view of the rotatable arc adjustment ring 103 when it is screwed onto the nozzle assembly housing 104. The rotational position of the lower adjustable stepped spiral element 103*a* at the top center of the arc adjustment ring 103 relative to the nozzle assembly body housing 104 is indicated around the lower circumference of the housing 104. This is also representative of the relative rotational position of the upper valve member 1022 (See FIG. 17, for example) which is keyed and locked into the body housing 104 to the ring 103.

Figure 17:
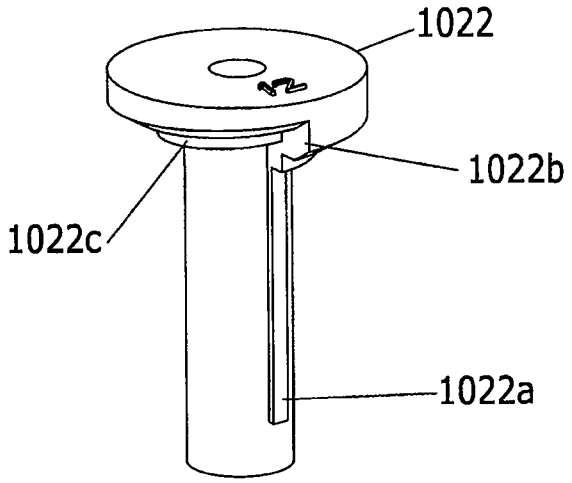
FIG. 17 shows an exemplary embodiment of an upper valve element of the nozzle assembly illustrated in FIGS. 11-13.

FIG. 17 shows an exemplary embodiment of the upper valve member 1022 which is held stationary by the key rib 1022*a* and key slot 104*c* of the center hole 104*b* of the nozzle assembly housing 104 of FIG. 16, for example. One advantage of the present invention is the stepped spiral element 1022*b* of the upper valve element 1022 and the lower stepped spiral element 103*c* of the ring 103 which forms the lower valve element in this case, have the same spiral step for a variety of flow rates. Flow rates can thus be altered based on the size of the opening A, specifically, via a second inner cylindrical spiral 1022*c* on the upper valve element 1022.

Figure 18:
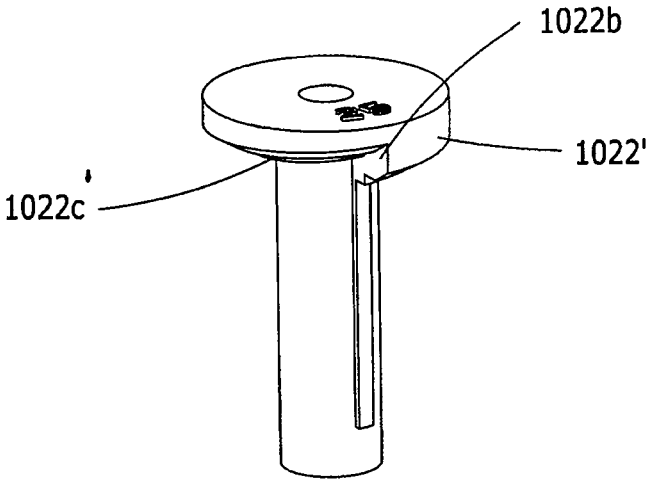
FIG. 18 shows an alternative embodiment of the upper valve member of FIG. 17.

FIG. 18 shows an alternative embodiment of an upper valve element 1022[1] with the same spiral and stepped element 1022*b*, but with its inner spiral 1022*c*[1] raised to provide a larger height opening for the opening A. The top of the upper valve member 1022[1] which can be snapped into the nozzle assembly house 104 is marked 25 to show that it will provide the correct flow rate at each arc of coverage setting for the designated precipitation within a 25 foot of radius. In contrast, the inner spiral 1022*c* of the upper valve element 1022 as shown in FIG. 17 extends further down axially and thus reduces the height of the opening A such that the flow rate of a nozzle assembly using this element will be reduced to that required for matched precipitation for a radius of only 12 feet.

Figure 19:
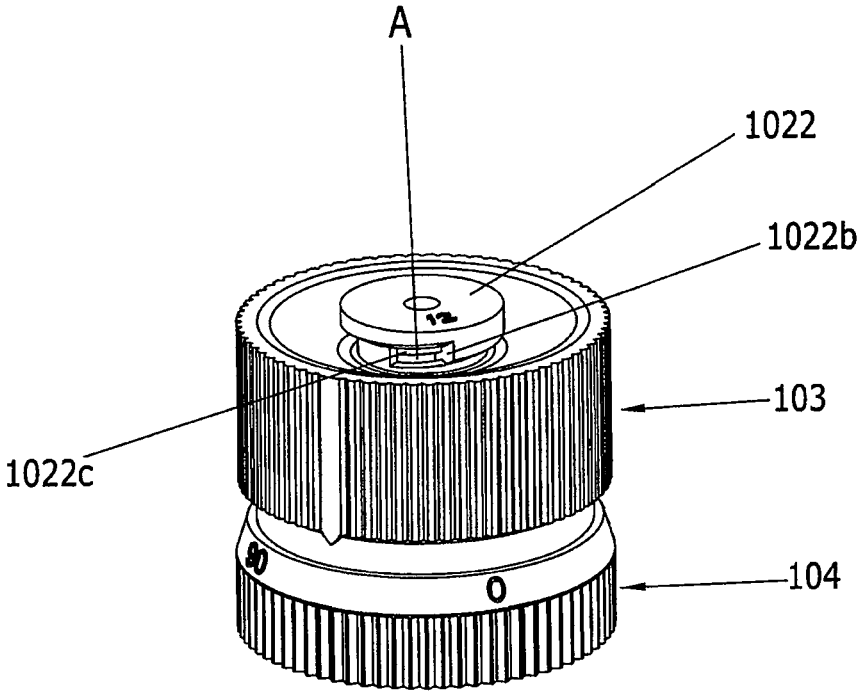
FIG. 19 shows a perspective view of the nozzle assembly housing of FIG. 14 with the arc adjustment ring of FIG. 15 and the upper valve element of FIG. 17.

FIG. 19 shows a perspective view of the nozzle assembly housing 104 with the arc adjustment ring 103 connected thereto and with the upper valve element 1022 inserted through the ring 103 and into the housing 104. As illustrated, the ring 103 indicates an arc of coverage set by opening A of something less than 90 degrees. That is, the length of the arcuate opening A will provide an arc of coverage of something less than 90 degrees around a sprinkler using the assembly 101. Further, the inner spiral 1022*c* on the upper valve element 1022 restricts the opening A slot height such that the flow rate of the sprinkler is reduced, but final adjustment of the range of coverage can be made with the threaded stream angle adjustment ring 102*a* as seen in FIG. 12.

Figure 20:
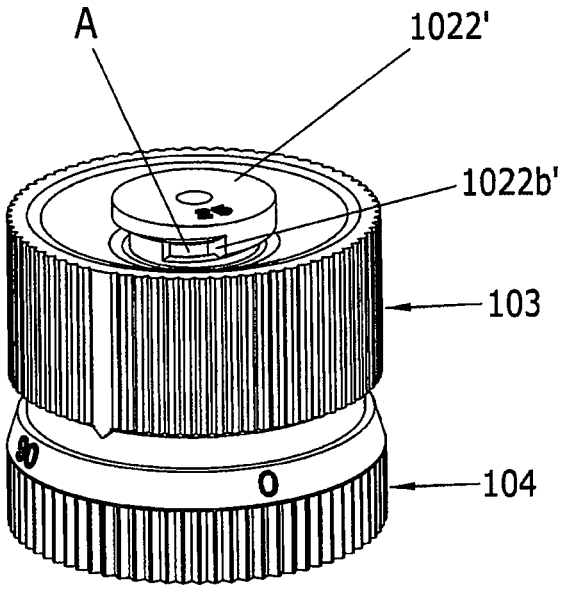
FIG. 20 is the same as the perspective view of FIG. 19 including the upper valve member of FIG. 18, except the upper valve element is for a larger slot height to allow increased resulting flow.

FIG. 20 is the same perspective view of FIG. 19, but the upper element 1022 is replaced by the alternative embodiment 1022[1] of FIG. 18. In this case, the size of the opening A provides for a range of 25 feet since the inner spiral 1022*c*[1] does not extend as far down axially as the inner spiral 1022*c*. Thus, adjusting the axial height of the opening A allows for an increased flow rate throughout the arc of coverage adjustment. Further, the correct flow rate for the range of any particular assembly can be quickly modified simply by changing out one part. As a result, most of the same parts, especially the large and threaded parts of the nozzle assembly 101 remain the same for different flow rates. Further, the diameter of the spiral and stepped element 1022*b* also remains the same in all upper valve elements.

Figure 21:
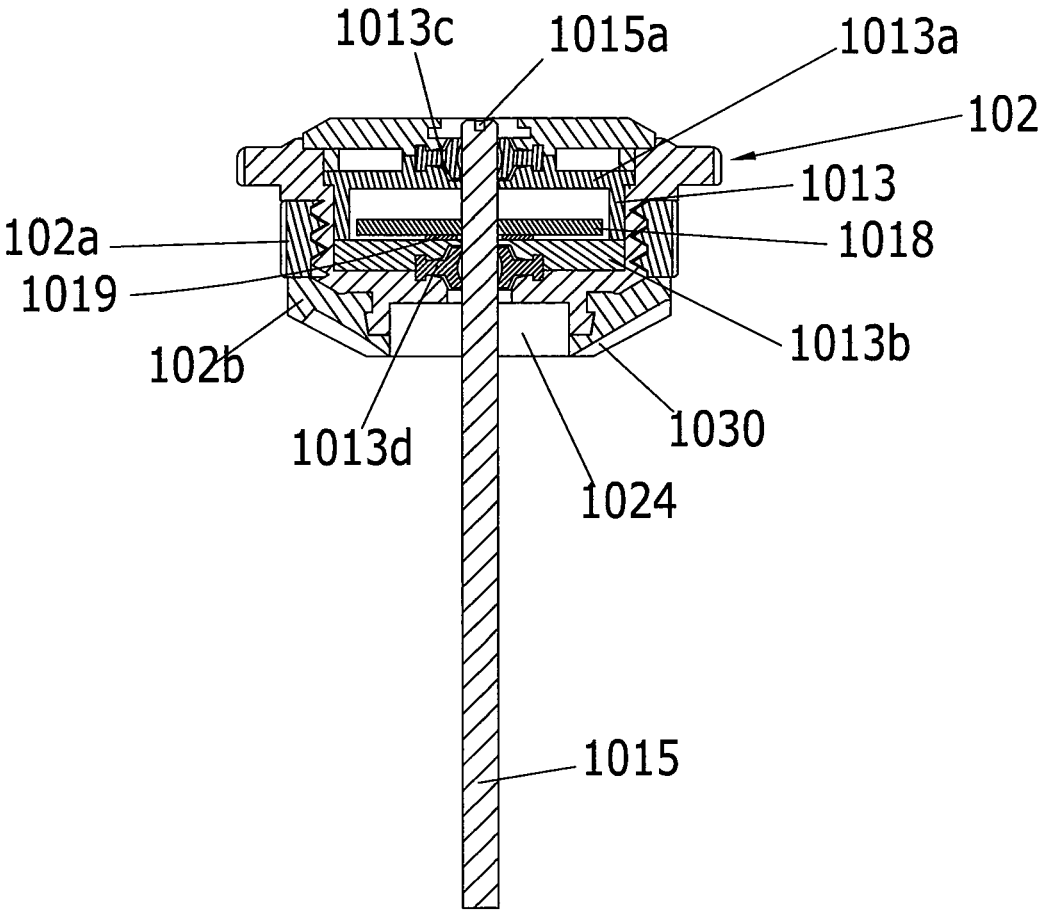
FIG. 21 shows a cross section of a rotating distributor of the nozzle assembly of FIGS. 11-13.

FIG. 21 shows a cross section of a viscous damped distributor 102 for use in the nozzle assembly 101. As illustrated, a viscous damping rotor disc 1018 is preferably press fitted to the shaft 1015 which is rotationally friction fitted into the nozzle assembly body housing 104 so that the distributor rotation speed is determined by viscous seal of a fluid or grease that is in the cavity 1013 around the stationary damping disc 1018 on the shaft 1015. The space between the shaft mounted damping disc 1018 and the inside bottom of the damping chamber 1013 in the rotating stream distributor 102 is preferably established by a Teflon thrust washer 1019 whose thickness can be changed to adjust speed with viscous shear spacing. Also, the viscosity of the oil or grease that the chamber 1013 is filled with can be changed, as desired.

FIGS. 24 through 33 illustrate yet another alternative embodiment of a nozzle assembly 201 in accordance with the present invention. The assembly 201 includes a pre-settable upstream throttling valve for automatically providing a desired precipitation at a selected range without resetting the upstream throttling valve for each arc of coverage setting since its opening is tied to the arc of coverage adjustment and is automatically opened further or closed further as the arc of coverage adjustment is moved. That is, the flow changes as the arc of coverage is adjusted.

Figure 24:
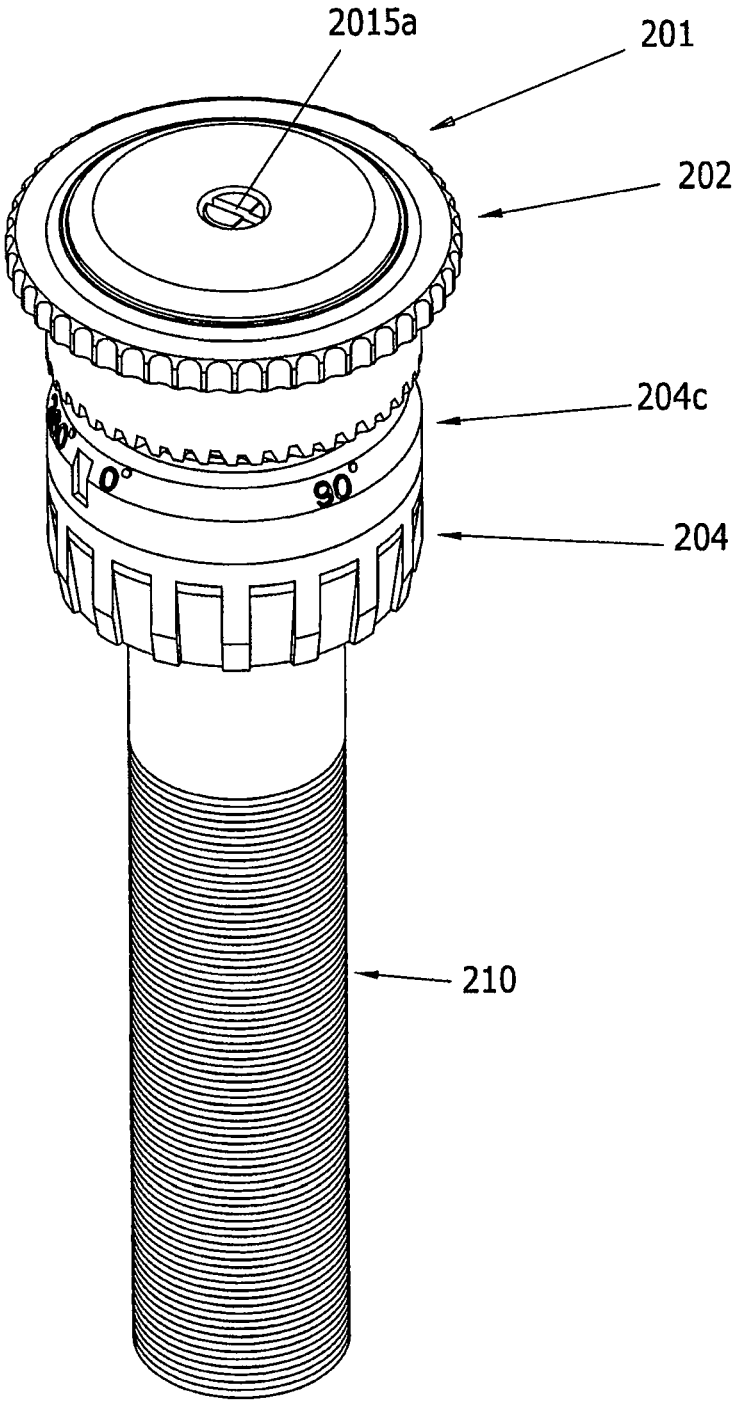
FIG. 24 is a perspective view of a stream rotor nozzle assembly in accordance with another embodiment of the present invention.

FIG. 24 is a perspective view of a nozzle assembly 201. The assembly 201 preferably includes a body housing 204 with a cover 204*c* attached thereto. In addition, a filter 210 may be provided connected to the body housing 204. The filter 210 is positioned in the sprinkler riser interior when the nozzle assembly 201 is attached to the sprinkler riser assembly for use.

Figure 25:
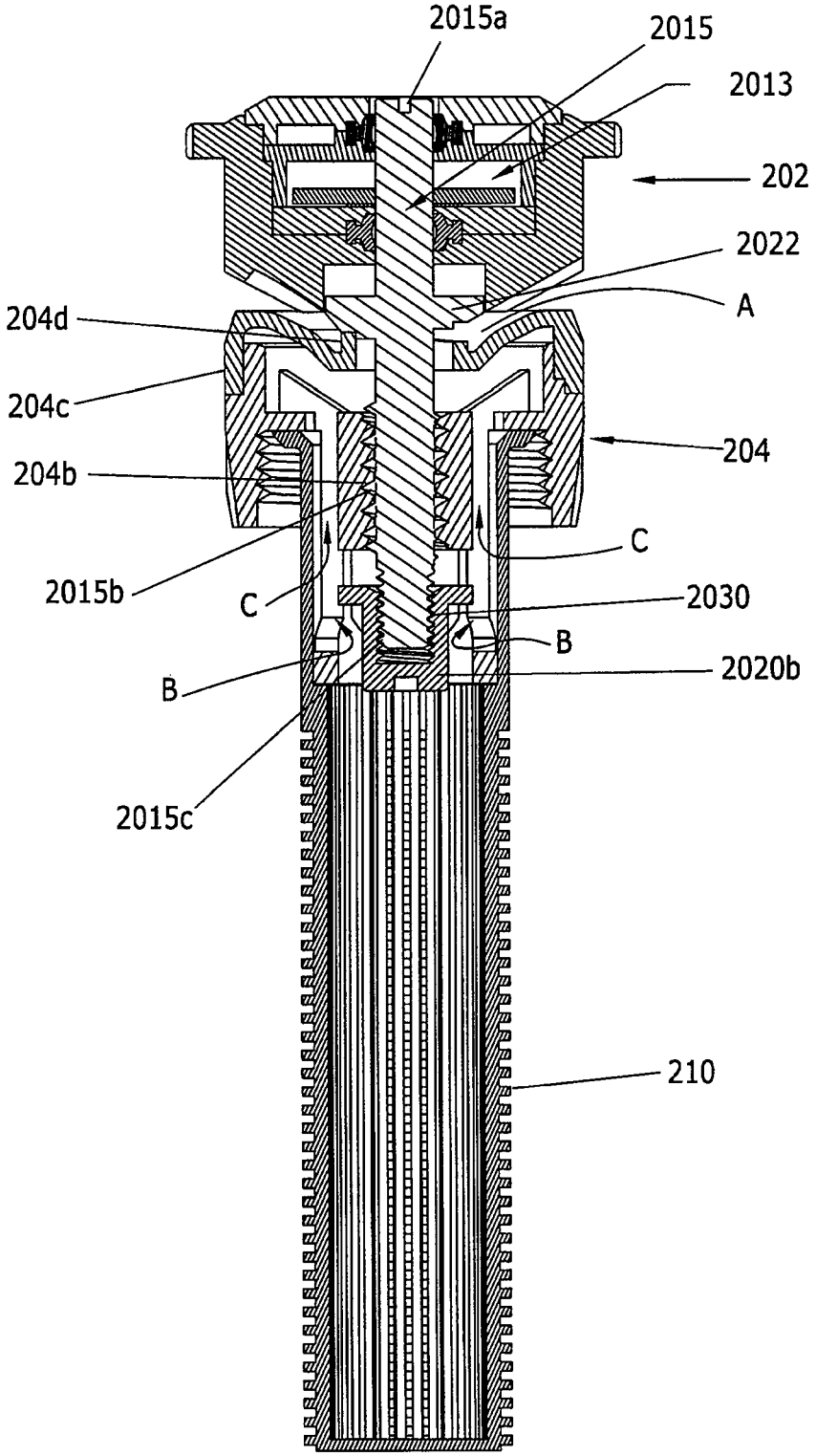
FIG. 25 shows a cross-sectional view of the nozzle assembly of FIG. 24.

FIG. 25 shows a cross-sectional view of the assembly 201 including the rotating distributor 202. A viscous damping chamber, or cavity, 2013 is provided in the distributor 202 in substantially the same manner as the damping chamber 1013 was provided in the distributor 102 previously described with reference to FIG. 11 and FIG. 12 above. However, in the nozzle assembly 201, the center shaft 2015 is integral with the upper valve element 2022 which is rotated by the shaft and rises to match the spiral to achieve continued shut-off of the unopened portion, by a thread 2015*b* on the center shaft 2015 that interacts with a thread in the center support hole of the nozzle assembly housing 204. The lower stepped spiral element 204*d* is positioned on the top cover 204*c* of the housing 204.

In this configuration, the upper valve element 2022 is rotationally moved axially upward (or downward) relative to the lower stepped spiral element 204*d* which is fixed to the body housing 204. The thread 204*b* that moves the shaft 2015 is also fixed to the body housing 204 since it is cut into the body housing center hole at a rotational position to cause the upper valve element 2022 of the shaft 2015 to provide a closure sliding contact sealing with the surface of the lower stepped spiral element 204*c*. The thread 204*b* has the same pitch as the stepped spiral elements 2022*b*, 204*d* that cooperate to form the arcuate opening A to provide rotation shut-off or opening. The upper valve element is moved up and down by rotating the shaft 2015 to match the spiral valving steps and keep the arcuate valving surface in contact by thread 2015*b* as the rotation of the upper valving element 2022 opens and closes the arcuate valve opening A. The top cover 204*c* and the housing 204 are fixed together by solvent welding or sonic welding.

To set the arc of coverage for this nozzle assembly the center shaft 2015 is rotated clockwise or counterclockwise by slot 2015*a*. In a direct one to one relationship the upper valving element 2022 stepped valving spiral 2020*c* stepped end 2020*e* is rotated. This stepped end 2020*e* is the adjustable side of the arcuate opening A, see FIG. 29. The fixed side of the adjustable arcuate opening is provided by surface 204*c* on the rotationally fixed nozzle assembly housing upper part 204*c*.

Figure 26:
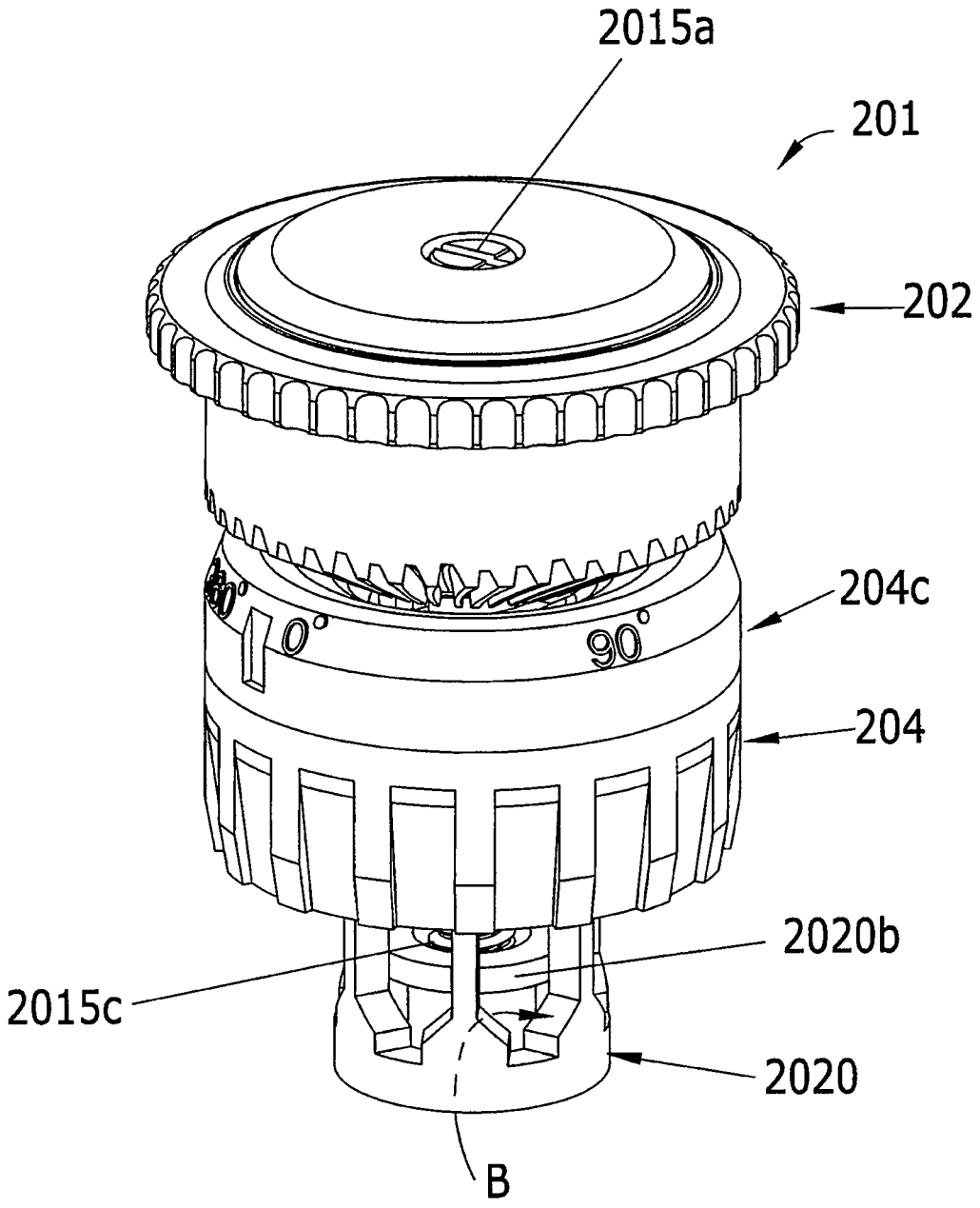
FIG. 26 is a perspective view of the rotary stream nozzle assembly of FIG. 24 with the filter assembly removed showing the upstream proportional flow throttling valve.

FIG. 26 is a perspective view of the rotary stream nozzle assembly 201 with the filter 210 removed to show the shape of upstream proportional valving parts 2020 which can be used in conjunction with an valving member 2020*b* mounted on the lower fine thread part 2015*c* of the arc adjustment shaft 2015 which can be better seen in the nozzle assembly cross-sectional view of FIG. 25. Since the center shaft 2015 moves up and down during the arc of coverage setting process and the lower end of the shaft 2015*c* is directly connected to the upstream flow adjustment valving member 2020*b* restricting action may be directly proportional to the increase or decrease of the arcuate flow area opening formed between the stepped spiral elements 2022*c*, 204*d*. Thus, once set at the factory or before mounting the nozzle assembly 201 onto a sprinkler, a desired range or precipitation rate can be set and automatically maintained when the arc of coverage is adjusted. That is, the movement of the element 2022 upward and downward depending on the changing arc angle of coverage also maintains the desired flow rate for each changed angle of coverage for a different range or precipitation rate than that provided by the basic nozzle assembly parts after the nozzle assembly has been assembled at the factory or during manufacture to provide a nozzle assembly for different ranges or precipitation rates using the same standard nozzle assembly parts.

Figure 27:
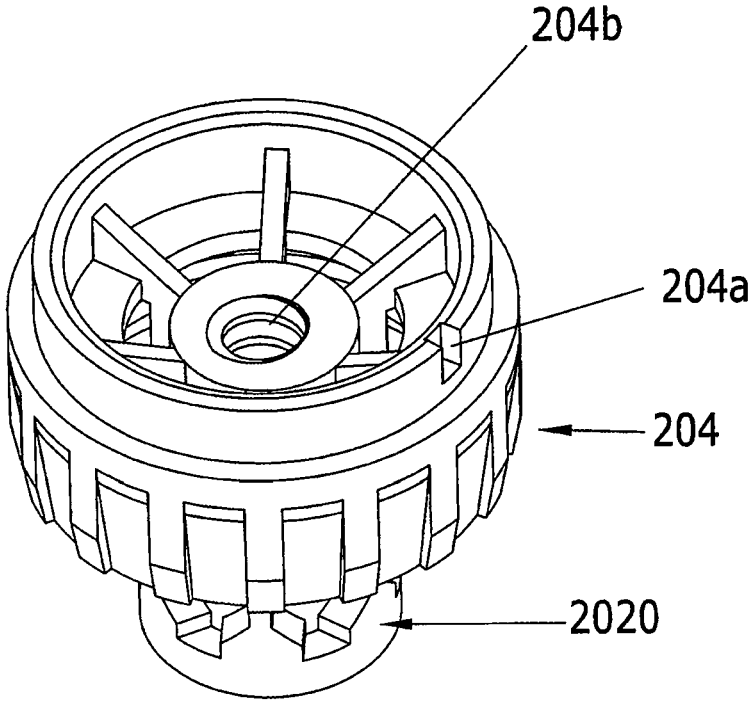
FIG. 27 shows a perspective of the nozzle assembly housing of the nozzle assembly in FIG. 24.

FIG. 27 is a perspective view of the housing 204 of the nozzle assembly 201 showing the key slot 204*a* for rotationally positioning the cover 204*c* lower valving member 2020 relative to the thread 204*b* to axially match the upper valve element 2022 shut-off spiral for sealing engagement.

Figure 28:
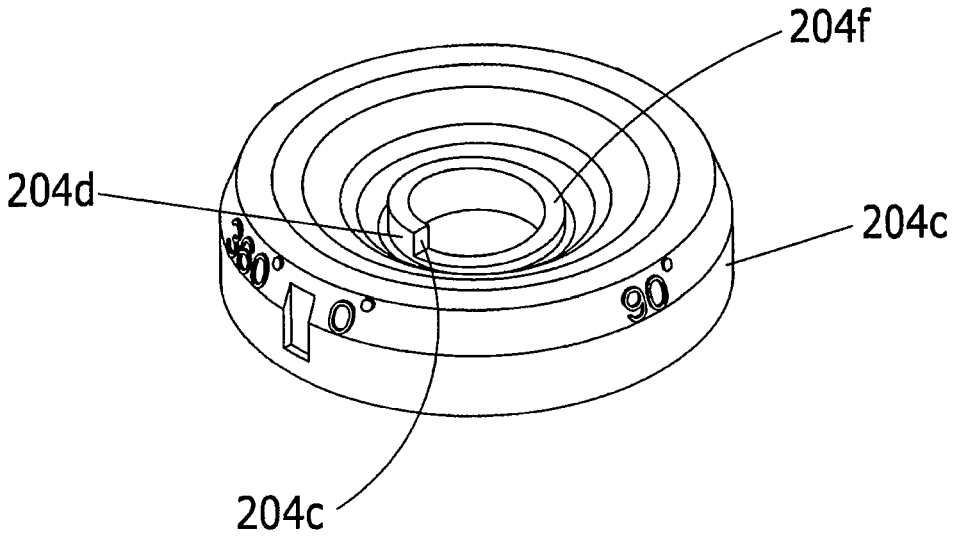
FIG. 28 shows a cover plate for the housing of FIG. 27.

FIG. 28 shows the cover 204*c* for the body housing 204. The larger stepped spiral element 204*d* is shown on top of the cover 204*c* around the center flow area. The reference degrees indicating the set arc of coverage are indicated around the periphery of the cover 204 for reference when setting the arc of coverage with slot 2015*a* and arrow recess 2015*e* as seen in FIG. 31.

Figure 29:
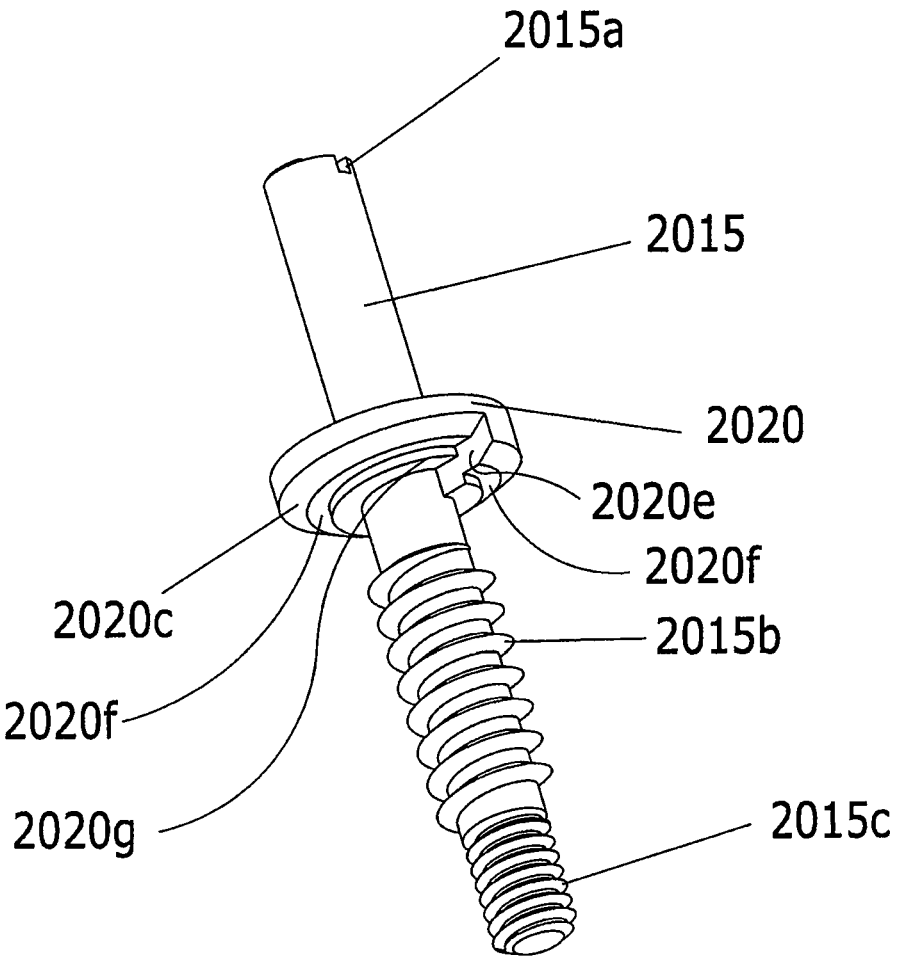
FIG. 29 shows a center shaft of the nozzle assembly of FIG. 24, which incorporated the upper arcuate valve member.
Figure 30:
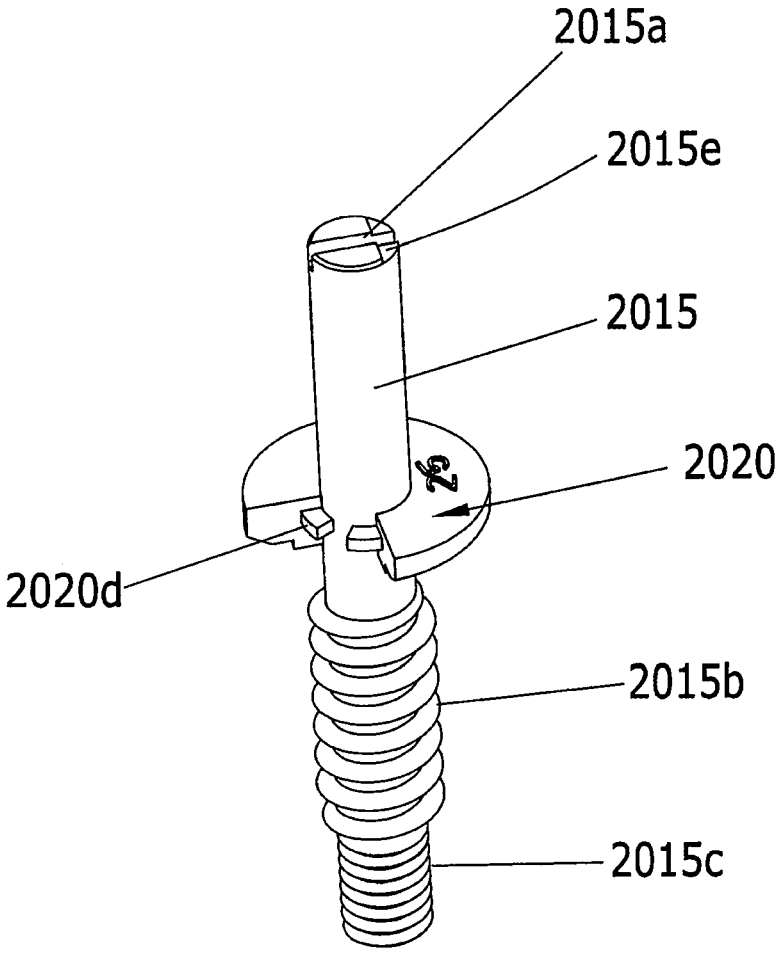
FIG. 30 shows a cut away of an upper valve element formed on the shaft of FIG. 29.

FIG. 29 shows the center shaft 2015 with the upper valve member 2022 preferably molded onto the shaft 2015. A stainless steel screw element 2022*d* (See FIG. 30) with a rib may be provided to maintain the position of the upper valve element 2022. FIG. 30 shows a cut away of the upper valve member 2022 that shows the stainless steel rib 2022*d* that can be formed on the shaft 2015 to maintain the valve element 2022 in position.

Figure 31:
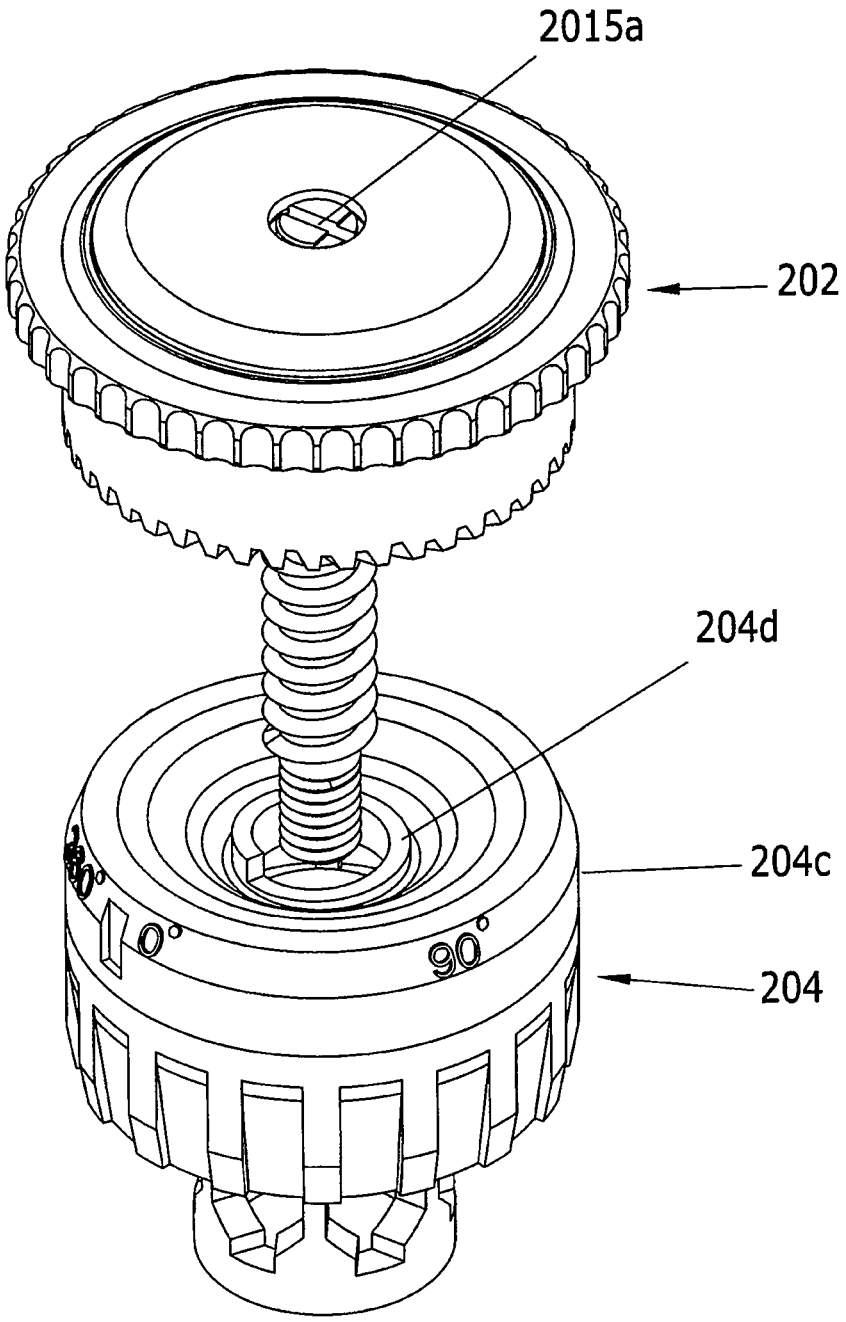
FIG. 31 shows a rotating distributor of the nozzle assembly of FIG. 24 removed from the nozzle housing assembly.
Figure 32:
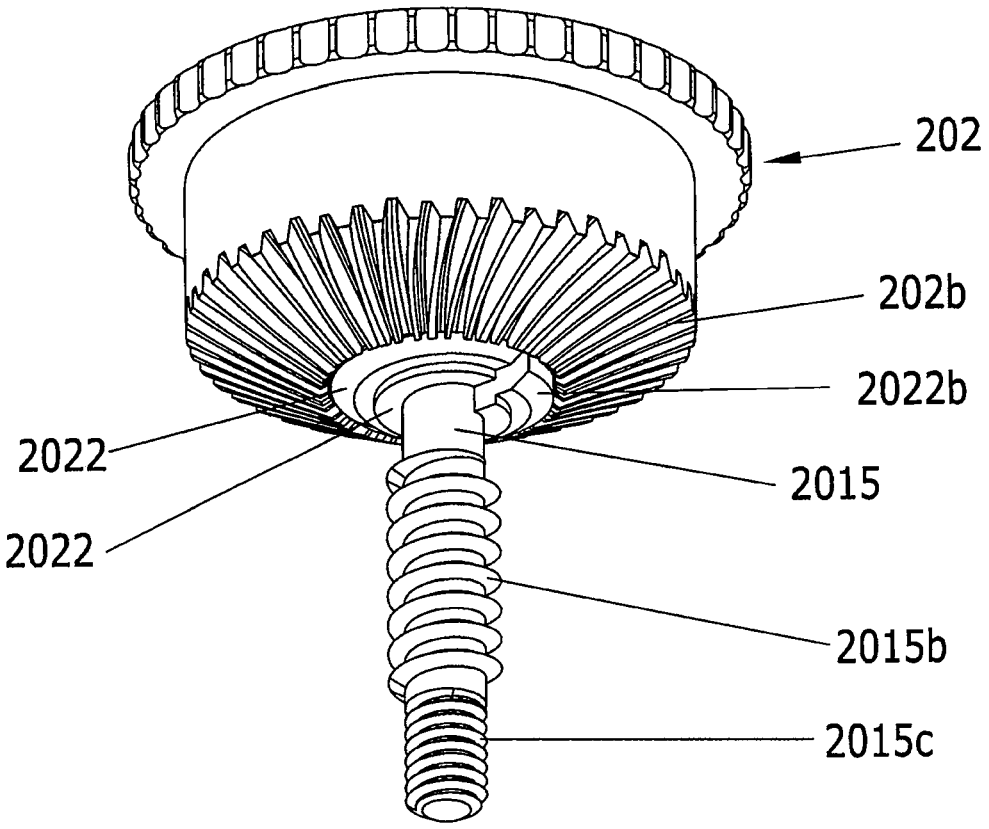
FIG. 32 is a perspective view of the underside of the distributor of FIG. 31.

FIG. 31 shows the rotating distributor 202 with internal viscous brake cavity 2013 mounted on the shaft 2015 for installation into the housing 204. FIG. 32 illustrates the underside of the distributor 202 showing a plurality of spiral grooves 202*b* formed therein which cause rotation of the distributor when water flows through the grooves and is distributed outwardly from the sprinkler assembly.

Figure 33:
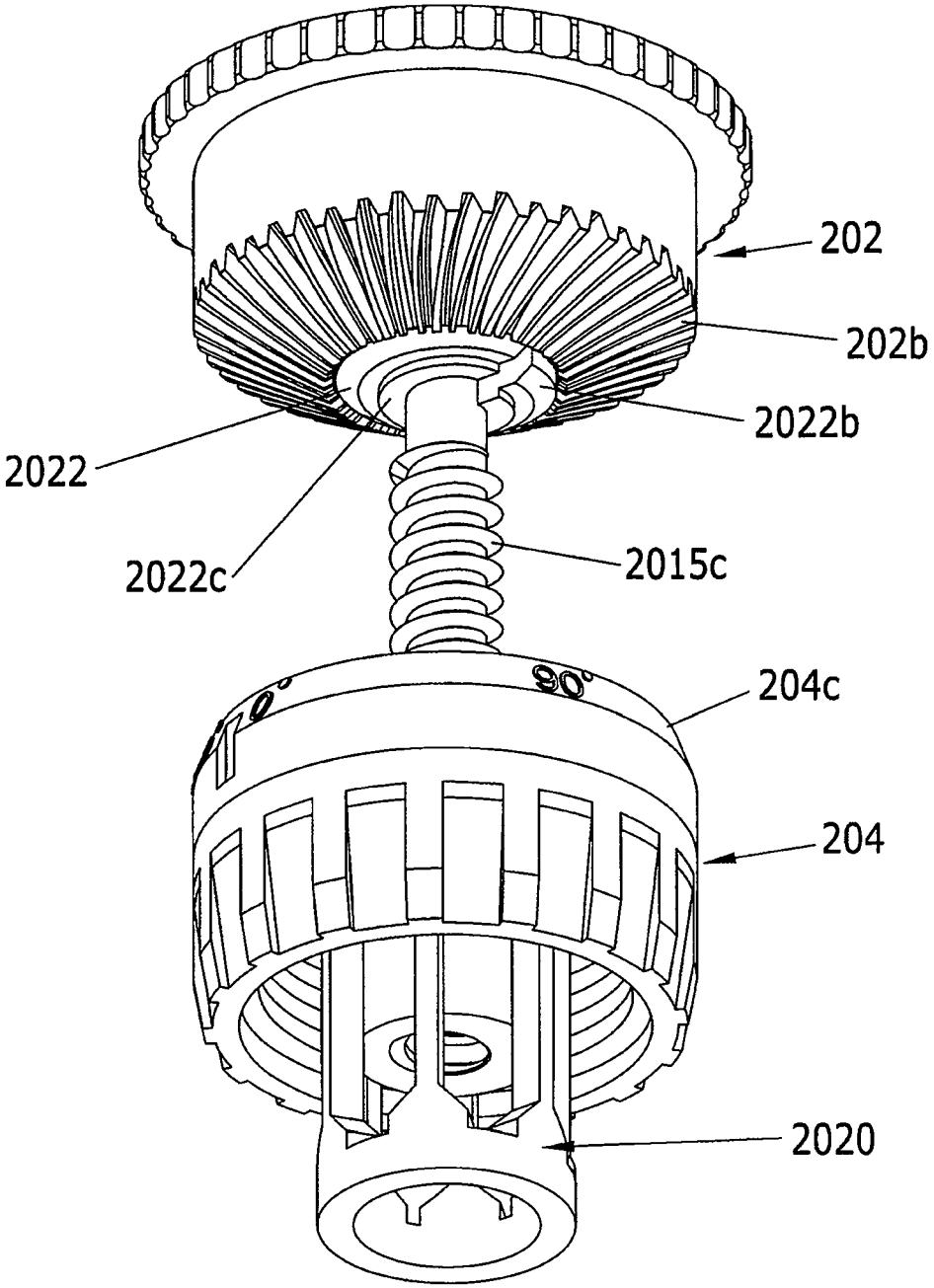
FIG. 33 is a low angle perspective view of the nozzle assembly housing of FIG. 27 and the distributor of FIG. 31.

FIG. 33 is a lower angle perspective view of the body housing 204 and upstream proportional valving part 2020 used for upstream valve flow control, as well as the shaft 2015 connected to the distributor 202 before the shaft is installed into the body housing. The valving ports of the valve element 2020 are used in a manner similar to the throttle valve 1020 discussed previously.

FIGS. 34-42 illustrate another embodiment of a nozzle assembly 301 with fully adjustable arc of coverage setting and indications of what is set including total shut-off in accordance with an embodiment of the present invention. The viscous rotational speed damping chamber 3013 (See FIG. 35) is provided in the sprinkler's stationary body 304 for greater mechanical durability and total flexibility to allow for changing of the distributor 302, for example. In this embodiment, the flow rate, precipitation rate, and particular range at all arc of coverage settings can be changed by only changing one part during assembly. The range can be independently adjusted at any time by turning the stream exit angle elevation angle adjustment screw 3040 to adjust the outer circumference axial position of the flexible stream distributor 302 and resulting stream elevation angles.

Figure 34:
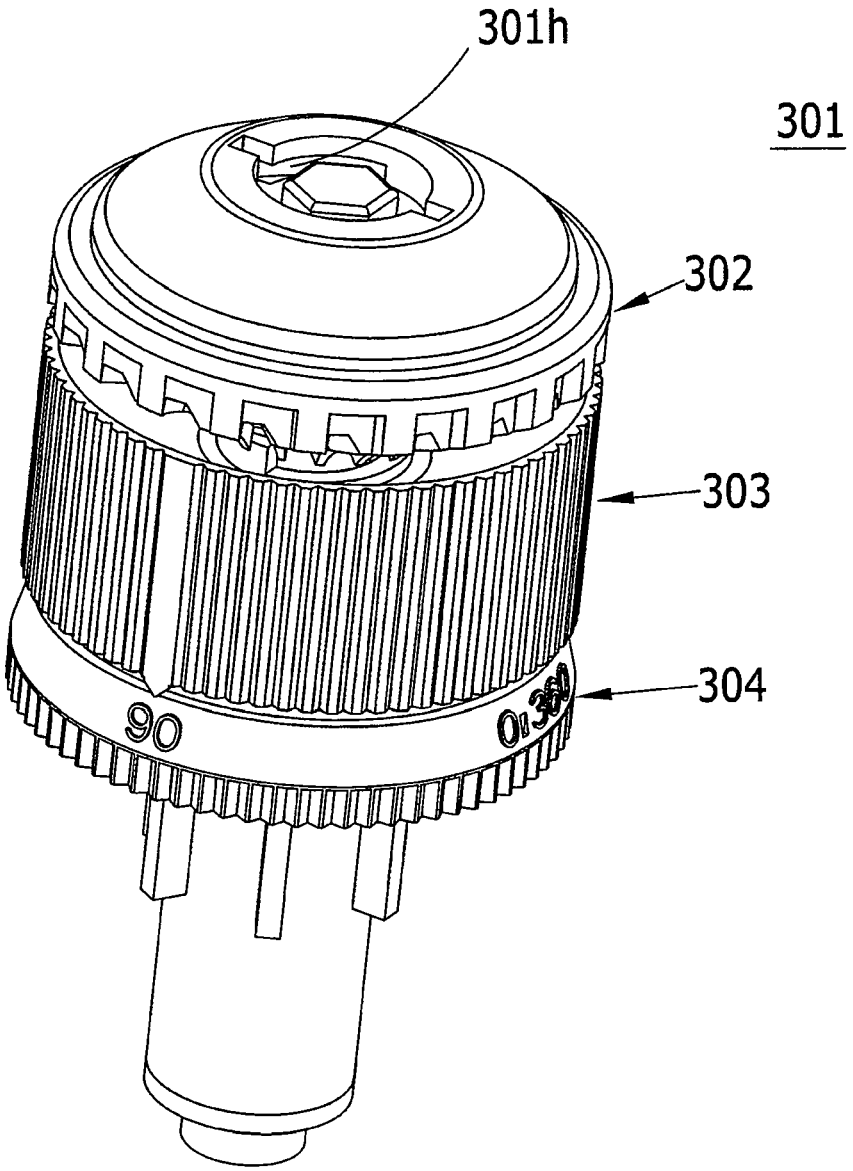
FIG. 34 is a perspective view of a sprinkler head nozzle assembly in accordance with another embodiment of the present invention.
Figure 41:
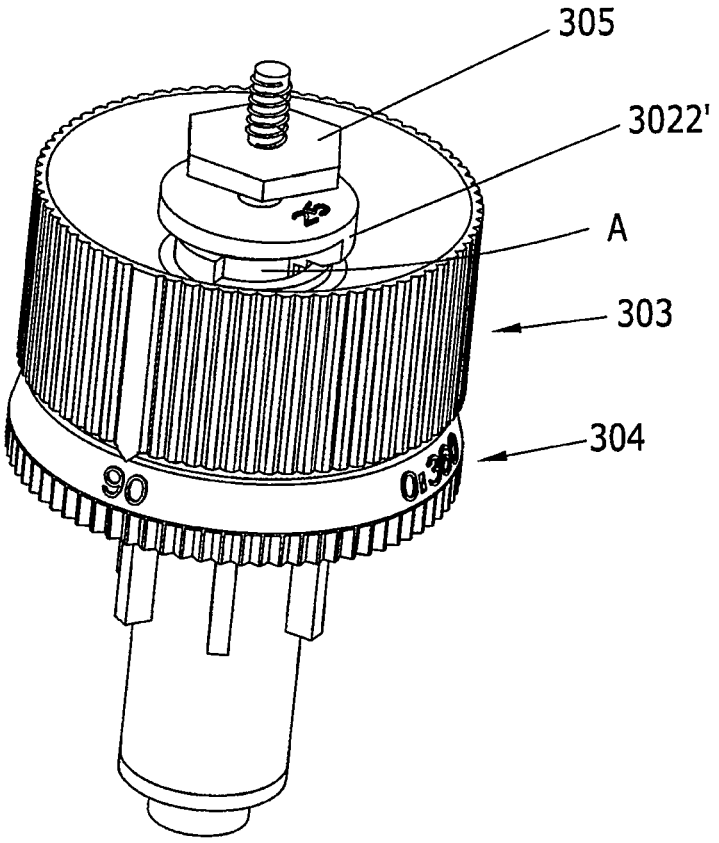
FIG. 41 shows a perspective view of the nozzle assembly of FIG. 35; housing of FIG. 36, the rotatable arc adjustment ring of FIG. 40 and upper valve member of FIG. 37 with the rotating stream deflector removed.

FIG. 34 is a perspective view of a fully arc adjustable and arc of coverage settable nozzle assembly 301. The nozzle assembly of FIG. 34 is similar to that of FIGS. 11-12 in that it includes a nozzle assembly housing 304 with an arc adjustment ring 303 connected thereto. An upper valve member 3022 (See FIG. 35) is set in the center hole of the ring and the housing with a stepped spiral element thereof cooperating with a lower stepped spiral element 303*b* on the top of the ring 303 to provide an arcuate opening A for a flow of water to be deflected out of the sprinkler via a rotating distributor 302. However, in the nozzle assembly 301, the rotational speed dampening chamber 3013 (FIG. 35) to dampen rotation speed of the distributor is positioned in the nozzle assembly housing 304 instead of in the distributor 102. Further, the assembly 301 allows for easy changing of the distributor 302 or removal for cleaning or inspection of the arcuate arc setting valve as can be seen in FIG. 41 with the rotating distributor 302 removed.

Figure 35:
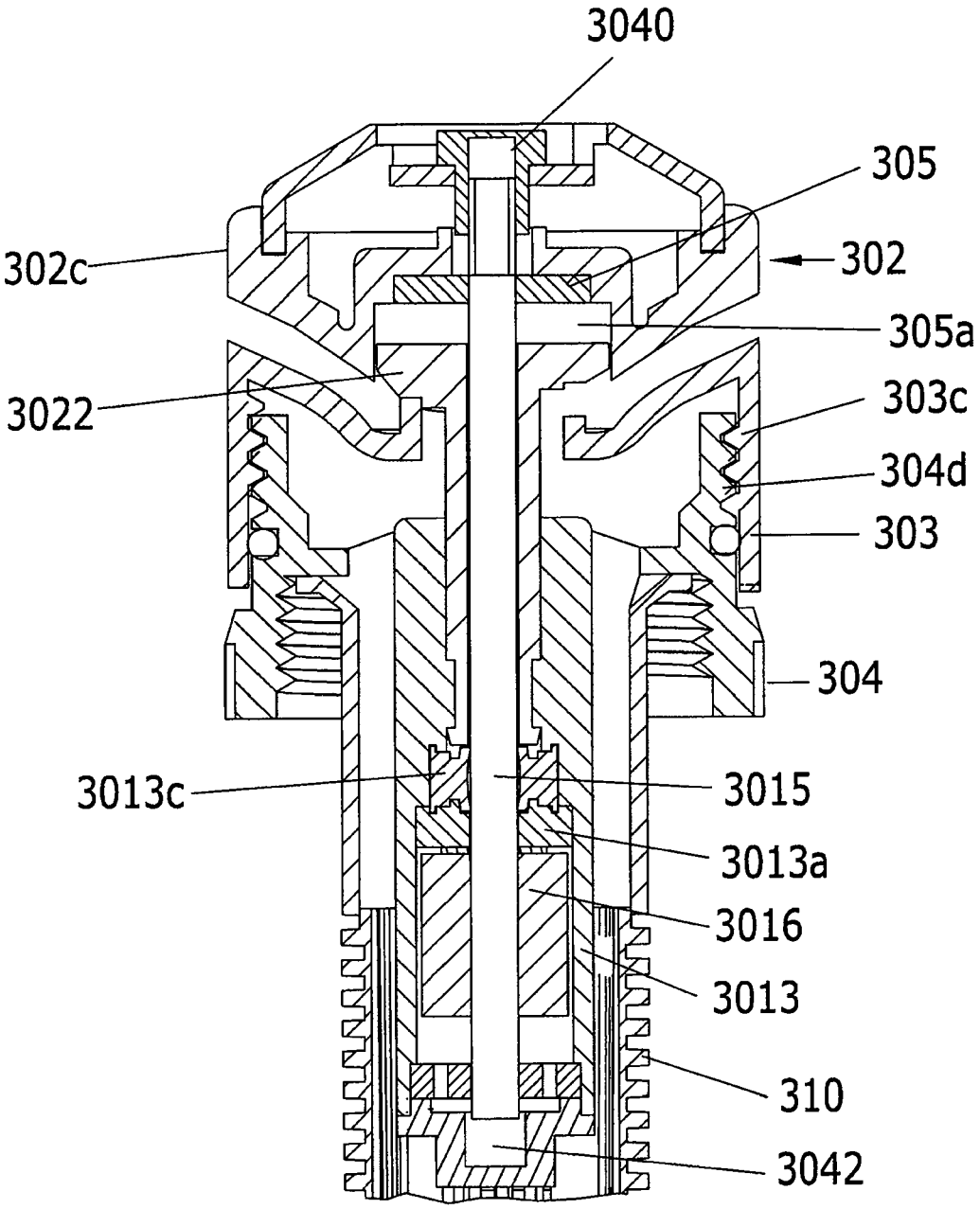
FIG. 35 is a cross section of the sprinkler head nozzle assembly of FIG. 34.

FIG. 35 is a cross section of the sprinkler nozzle assembly 301 of FIG. 34. The arc adjustment ring 303 is connected to the body 304 via the threads 303*c* of the ring and the thread 304*c* of the housing 304. The threads have the same pitch as the stepped spiral elements 3022*b* of the upper valve member 3022 (See FIG. 37) and 303*b* of the ring 303 which cooperate to form the arcuate opening A. These elements act is substantially the same manner as the ring 103 and valve element 1022 described above with reference to FIGS. 11-24.

The viscous rotational speed damping chamber 3013 is preferably positioned in the lower portion of the nozzle assembly 301. The internal rotor 3016 is preferably press fitted onto the shaft 3015 that protrudes upward through a bearing plate 3013*a* and shaft lip seal 3013*c* and then through the stem of the upper valve member 3022. A hexagon-shaped plate 305 is preferably press-fitted onto the rotating shaft 3015 and supports the distributor 302. A motion chamber 305*a* is provided in a bottom portion of the distributor 302, such that when the distributor 302 is pressed down the bottom of the distributor rests against the top of the arc adjustment ring 303 and prevents damaging the damping chamber 3013 or rotor. Further, the stream angle adjust screw 3040 is provided to modify the hard rubber deflector 302*c*. A motion allowance space 304*e* is also shown below the rotor 3016 to allow for axial movement of the shaft 3015.

The rotational speed is controlled by viscous dampening based on the clearance between the rotor 3016 which is press fitted onto the shaft 3015 and the side clearance between the rotor cylinder and the inside chamber walls 3013*a*, 3013*b* as well as the viscosity of the grease that partially fills the chamber 3013.

The thread in the nozzle assembly housing 304 for attachment to the riser (not shown) of a sprinkler can also be seen as well as the upstream filter 310 which can be larger and long and extended down into the sprinkler riser tube. The filter 310 is slide fitted onto ribs around the damping chamber 3013. The nozzle assembly is shown mounted on a sprinkler riser assembly in the pressure off retracted position in FIG. 43.

Figure 36:
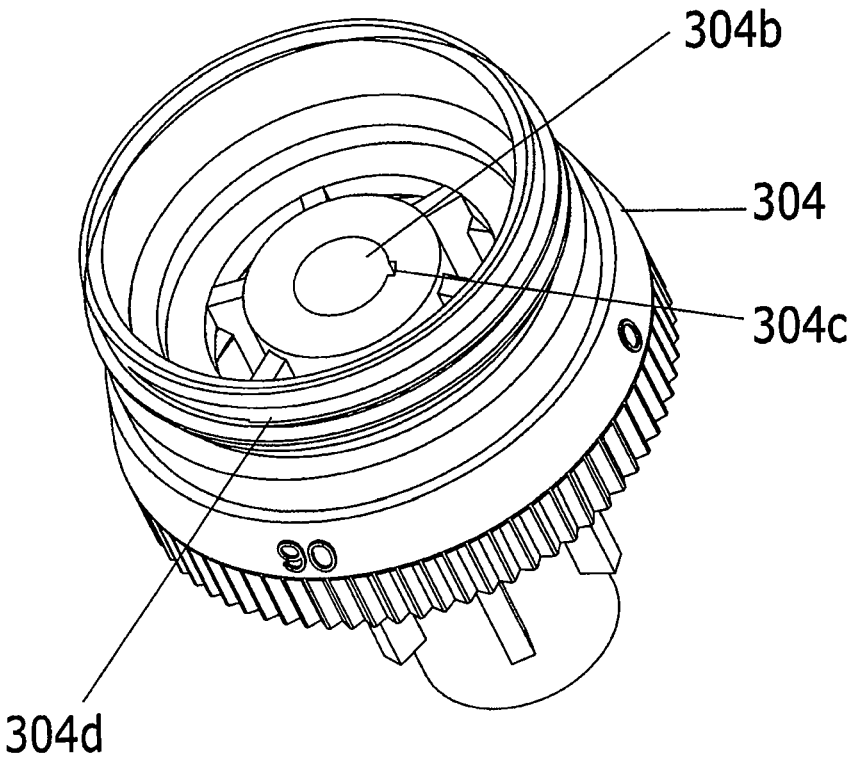
FIG. 36 shows a perspective view of the inside of the nozzle assembly housing of the nozzle assembly of FIGS. 34-35.

FIG. 36 shows a more detailed view of the nozzle assembly housing 304 showing the threads 304*d* around the upper circumference for mating with the arc adjustment ring 303. Also the center hole 304*b* where the matching upper valve member 3022 is pressed into and rotationally locked by the key way 304*c*. The arc of coverage setting degrees are indicated around the lower circumference of the nozzle assembly body housing 304. Further, the lower outer circumference of the housing 304 is preferably serrated for holding the housing 304 as the arc adjustment ring 303 is rotated to set the arc of coverage.

Figure 37:
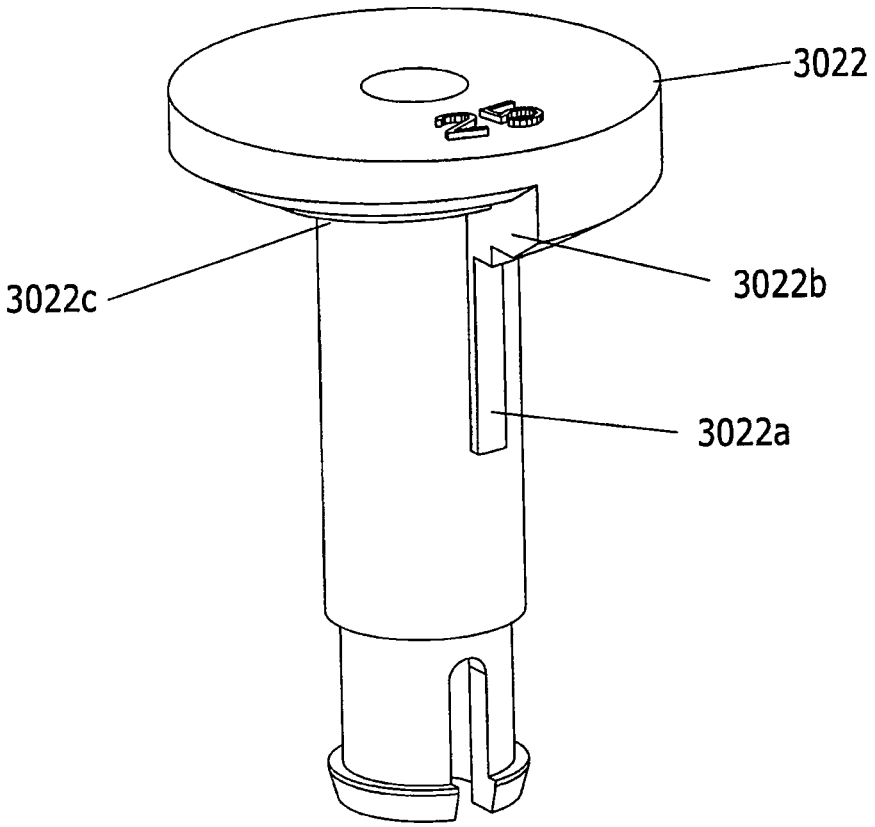
FIG. 37 shows an upper valve member of the nozzle assembly of FIGS. 34-36, for i.e. 25 feet of range.
Figure 38:
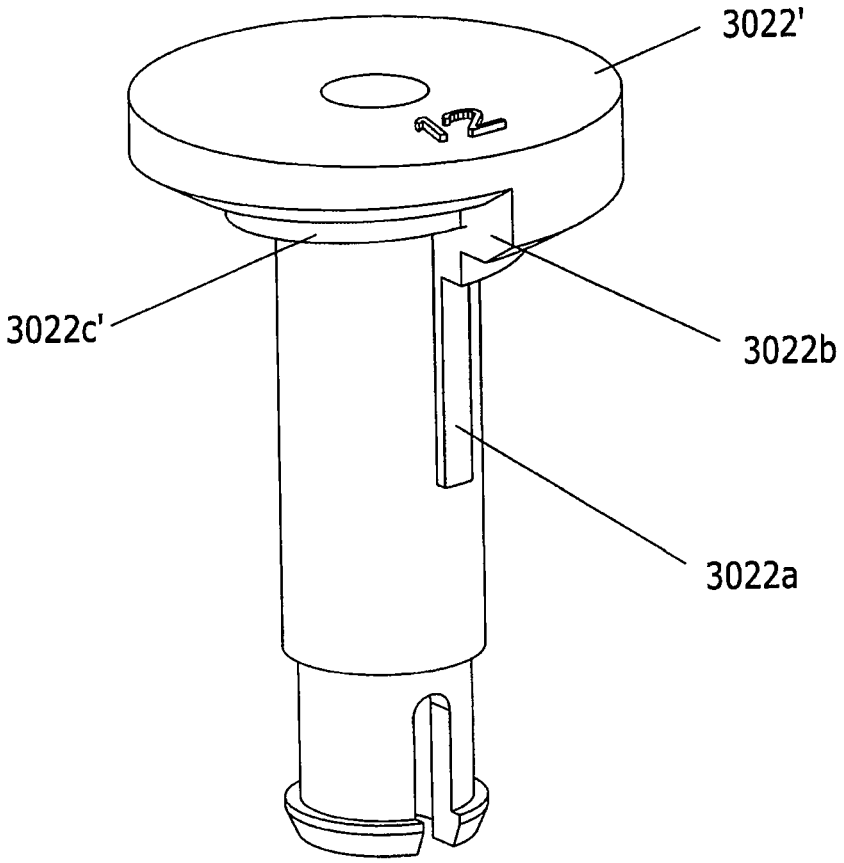
FIG. 38 shows an alternative embodiment of the upper valve member of FIG. 37, for i.e. 12 feet of range.

FIG. 37 shows an exemplary embodiment of the upper valve element 3022 which is held rotationally stationary by the key rib 3022*a* and key way 304*c* shown on the center hole 304*b* of the nozzle assembly housing 304 of FIG. 36. The element 3022 is structured such that the same sized and shape element spiral valving elements and housing arc of coverage thread 304*d* can be used while flow is adjusted based on an axial change in height of the arcuate adjustable length valving slot by the secondary internal spiral 3022*c* whose axial height determines the flow area of the arcuate slot. Thus, the flow adjustment can be made during manufacture by changing only the upper arcuate valving member 3022 as per FIG. 37 or FIG. 38, for example. This is felt to be a unique inventive feature of this arcuate adjustable valve design. As a result the upper element 3022 of FIG. 37 is used to set a proper flow rate for matched precipitation for all of the irrigation system's sprinklers when installed on the same piping zone of irrigation at the selected range of, for example, 25 feet, as is indicated on the top thereof, whereas the upper element 3022[1] provides for the proper flow rate for a range of, for example, 12 feet. Thus, the flow rate range of the nozzle assembly 301 can be modified by replacing a single part, the upper valve element 3022, to provide the desired flow rate automatically for a particular desired range of coverage without having to change to spiral valve step or housing matching thread pitch. Once the flow rate is correct for a particular range, the exact range of coverage can be adjusted by the distributor stream exit angle adjustment using screw 3040 as previously discussed and shown in FIG. 34 and FIG. 35.

Figure 39:
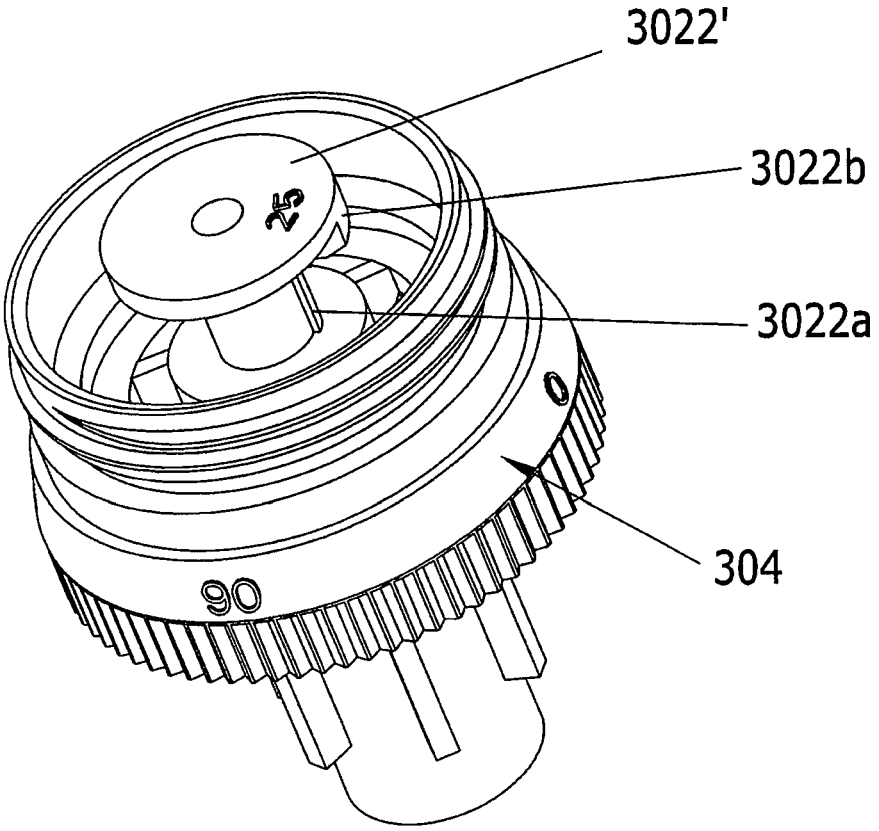
FIG. 39 shows a perspective view of the nozzle assembly housing of FIG. 36 with the upper valve member inserted into the lower nozzle housing member of FIG. 38.

FIG. 39 shows a perspective view of the nozzle assembly housing 304 with the upper valve member 3022 mounted therein. As noted above, this valve member configured to provide the proper flow rate for a range of 25 feet. It is noted that different valve members may be selected if desired during manufacture to provide the proper flow rate for matched precipitation at different ranges.

The arc adjustment ring 303 which has the lower valve member 303*a*, is screwed into place on the nozzle assembly body housing 304 during manufacture prior to the upper arcuate valve member 3022*b* being snapped into the housing 304.

Figure 40:
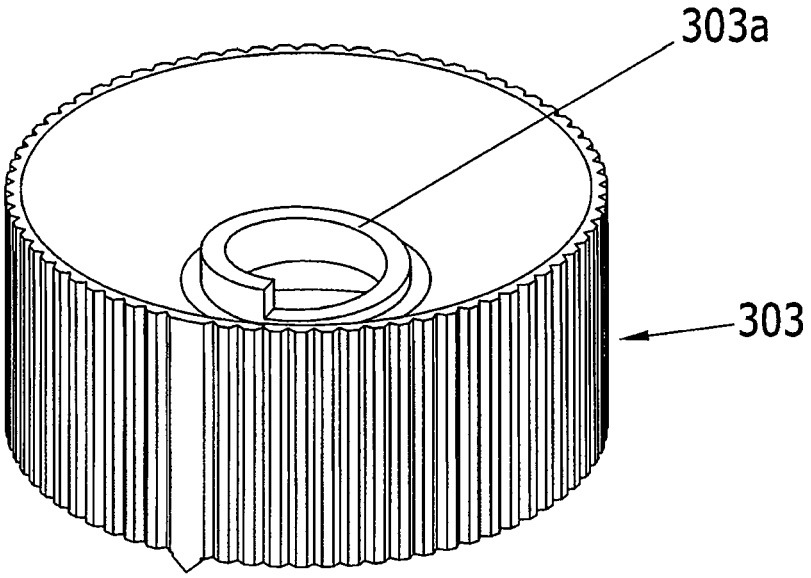
FIG. 40 shows a perspective view of the rotatable arc adjustment ring of the nozzle assembly of FIGS. 34-35.

FIG. 40 shows a more detailed view of the arc adjustment ring 303 which is screwed onto the nozzle assembly housing 304 by its circumferential internal thread (not shown). The serration around the outside of the ring 303 allows for easy turning of the ring to set the desired arc of coverage. The lower stepped spiral element 303*a* is also illustrated in the top of the ring 303.

FIG. 41 shows a perspective view of the housing 304 and arc adjustment ring 303 attached thereto. The upper valve element 3022 is slid into the center opening of the adjustment ring 303 and the housing 304 where it is locked in place relative to the housing 304. The upper valve element 3022 is shown portioned relative to the ring 303 spiral arcuate valving surface 303*a* such that the angle of coverage is shown set at approximately 90 degrees; the opening A. The arc of coverage is fully adjustable from 0 degrees (shut off) to 360 degrees of coverage by the nozzle assembly. Obviously at very low arc settings the rotational speed of the stream rotor distributor will be very slow, perhaps less that one revolution per minute, but it will provide fully functional sprinkler coverage. In addition, it is desirable that the nozzle can be fully shut off if desired as well. Also, the hexagon plate 305, or nut, is also illustrated as press fitted or screwed onto the shaft 3015. This hexagon shape fits into the hexagon shape on the underside of the distributor as shown in FIG. 42 to rotationally lock the distributor 302 to the shaft 3015.

Figure 42:
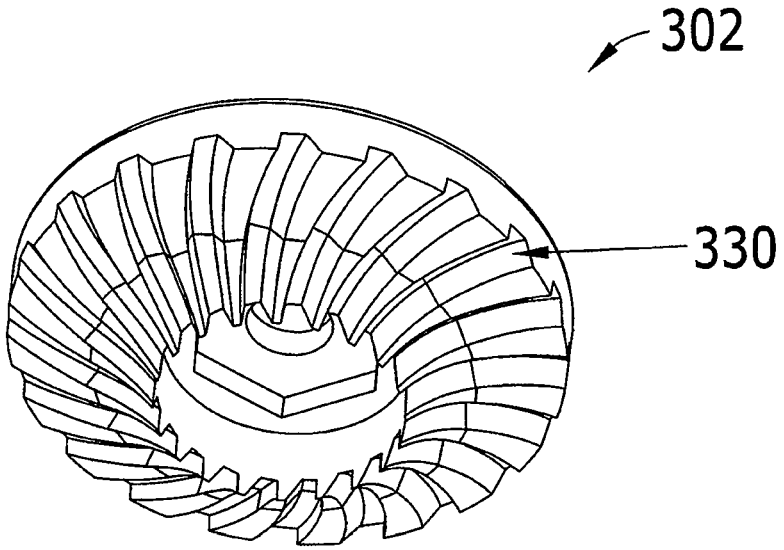
FIG. 42 is a perspective view of the underside of a rotating spiral grooved distributor of the nozzle assembly of FIGS. 34-35.

FIG. 42 is a perspective view of the underside of the deflector 302*a* attached to the distributor 302 illustrating the hexagonal mounting hole for the plate 305.

Figure 44:
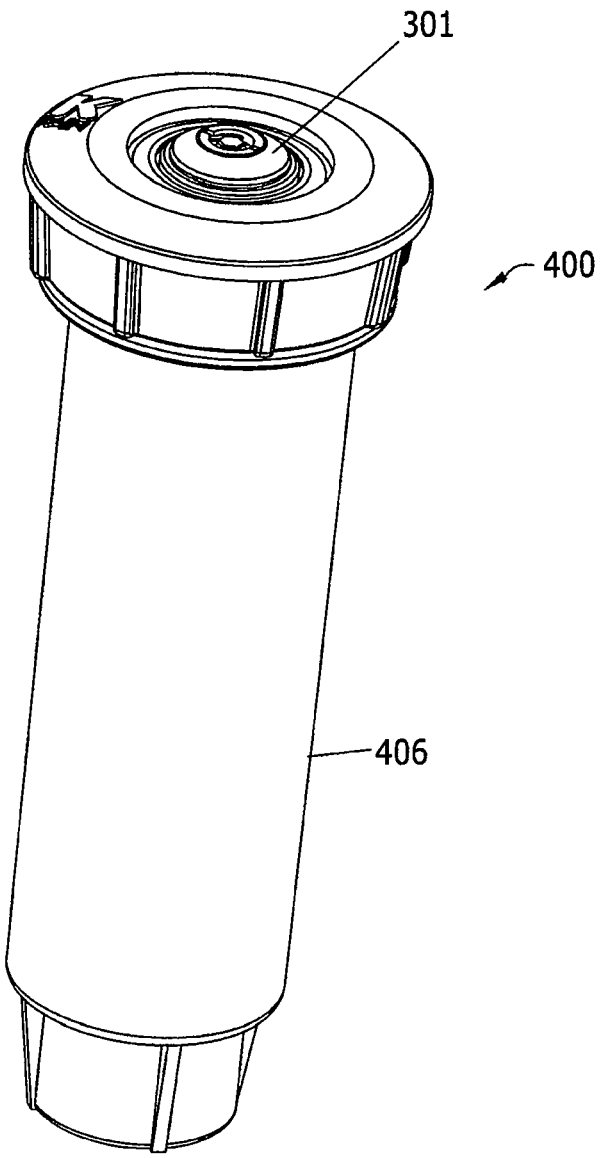
FIG. 44 shows a perspective view of the sprinkler with the nozzle assembly attached thereto and in the retracted position.
Figure 45:
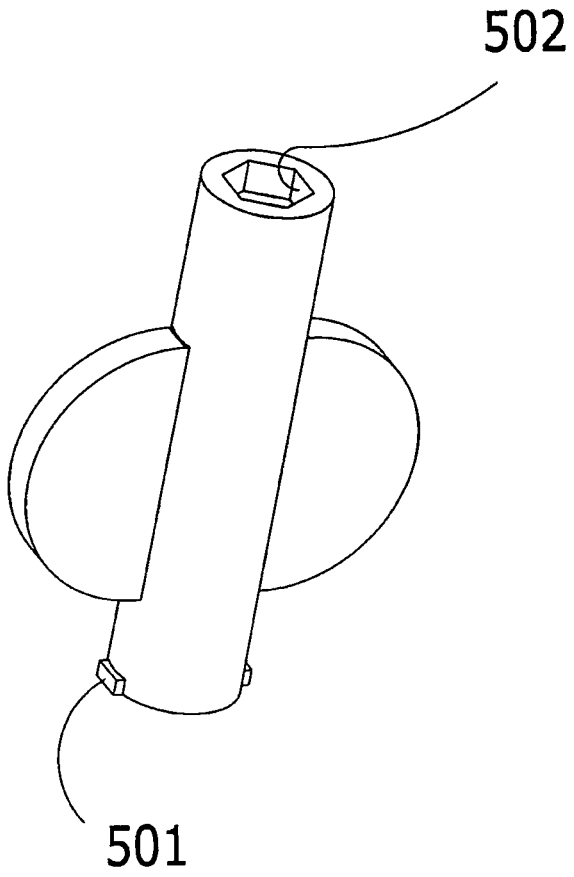
FIG. 45 illustrates an exemplary embodiment of an insertable stream elevation exit angle adjustment and twist lifting tool for the nozzle assembly of FIG. 44.

FIGS. 43 through 45, show an exemplary nozzle assembly in accordance with any of the embodiments of the present invention described above installed on a pop-up sprinkler 400 that preferably includes anti-vandalism features and a lift tool. The nozzle assembly is relatively inaccessible without a riser lift tool to raise the riser out of its housing which helps deter vandalism.

FIG. 43 shows a cross sectional view of the sprinkler 400 with a viscous damped nozzle assembly similar to that illustrated in FIGS. 34-35 of the present application, for example. The riser 402 is shown retracted into the housing 406 based on the resilient force provided by the spring 402.

FIG. 44 shows a perspective view of the sprinkler 400 with the nozzle assembly essentially flush with the top of the sprinkler riser seal area which is recessed below the top cover surface for further protection of nozzle assembly. The nozzle assembly is preferably similar to that illustrated in FIG. 11 or 14 of the present application which may protrude above the top of the sprinkler top and be vulnerable to line trimmer damage or theft since it provides an edge around the distributor that may allow for lifting of the lift the nozzle and riser assembly out of the sprinkler housing exposing it to theft or vandalism.

FIG. 45 is an exemplary embodiment of an insert and twist tool 500 for lifting the nozzle assembly of FIG. 44, for example, up for changing or inspection. The lugs 501 protruding from either side can be rotated into lifting engagement with over-hanging surfaces **301*h* in the nozzle assembly distributor top as shown in FIG. 34**.

Figure 46:
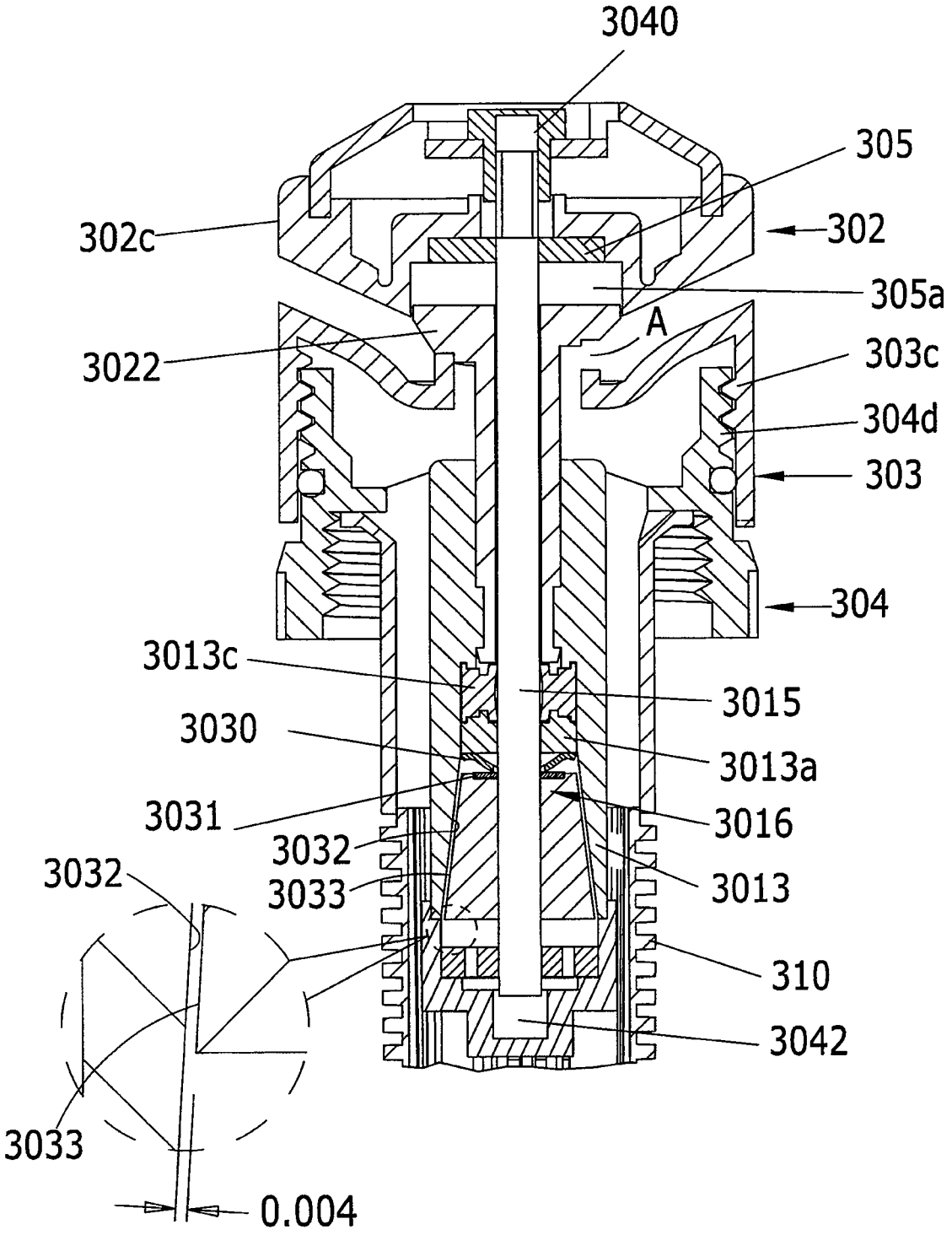
FIG. 46 shows a cross-section of a sprinkler nozzle assembly such as FIG. 35 with a tapered damping rotor and matching inside housing for more constant speed compensation with increased flow due to setting a larger arc of coverage or supply pressure changes.
Figure 47:
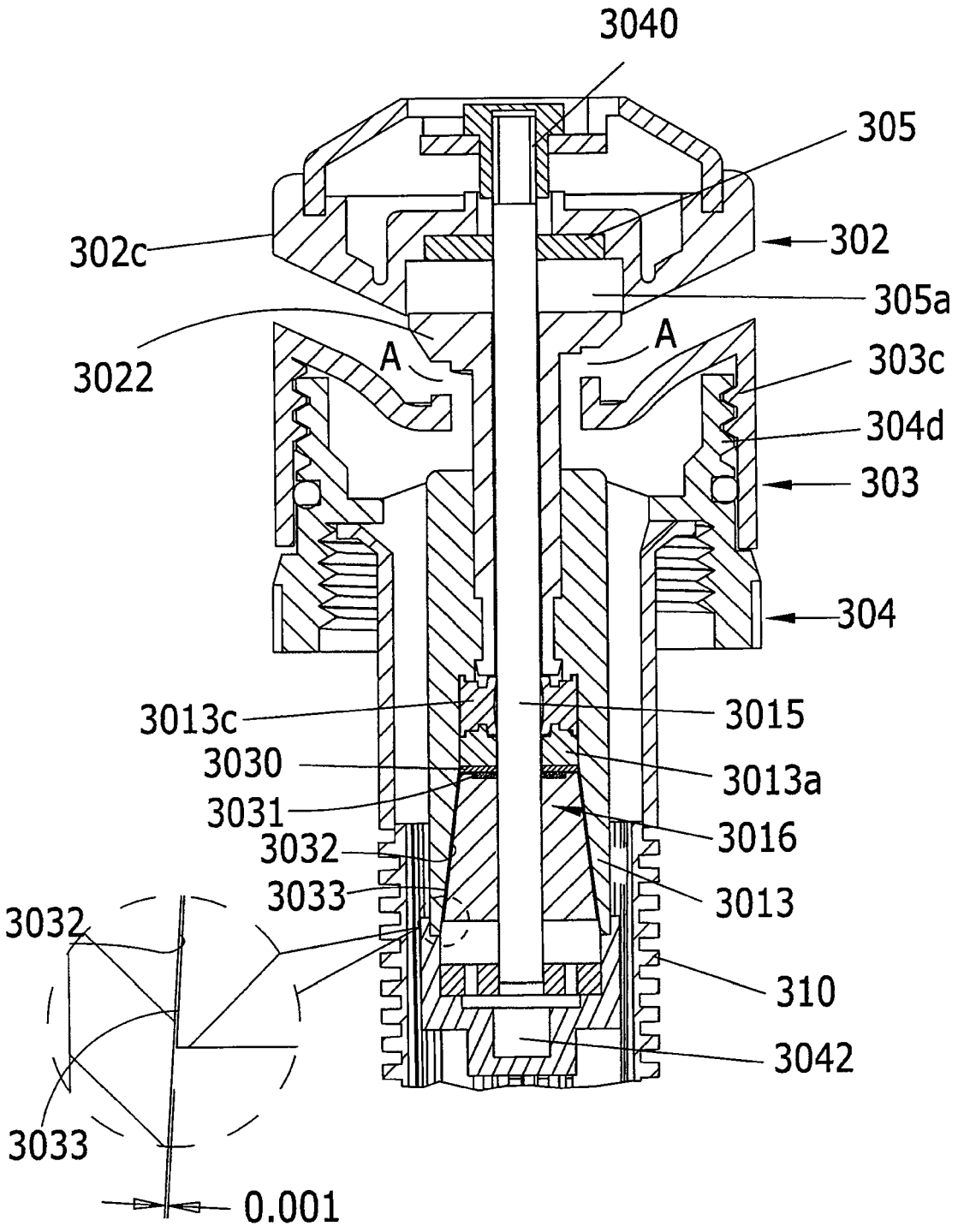
FIG. 47 shows a cross section of the sprinkler nozzle assembly of FIG. 46, with the tapered damping rotor pulled up due to a fully open arc setting to provide closer damping rotor clearance with the housing walls for more rotational speed damping.

FIG. 46 shows a cross-section of a sprinkler nozzle assembly such as that shown in FIG. 35, but with a tapered damping rotor 3016 and matching taper angle cylindrical inside diameter 3032. The rotor assembly is biased downwardly by a short axial movement low spring force and spring rate wave washer 3030 acting against a rotational thrust washer 3031. As the arc of coverage valve is opened by rotating arc set ring 303 the arcuate open A provides more flow against the stream rotor distributor 302 putting more axial load on it as well as more rotational load. This compresses the wave washer 3030 and allows the tapered rotor to be moved axially upward and closes the running gap between the speed damping rotor 3016 outside surface 3033 and the stationary inside housing surface 3032 providing compensating additional viscous damping to maintain the rotational speed of the distributor more constant for the higher flow rate due to the additional arcuate slot length for the greater arc of coverage. Both sides of the arcuate valve are shown open at A in FIG. 47 where the wave washer spring 3030 is shown fully compressed.

Figure 48:
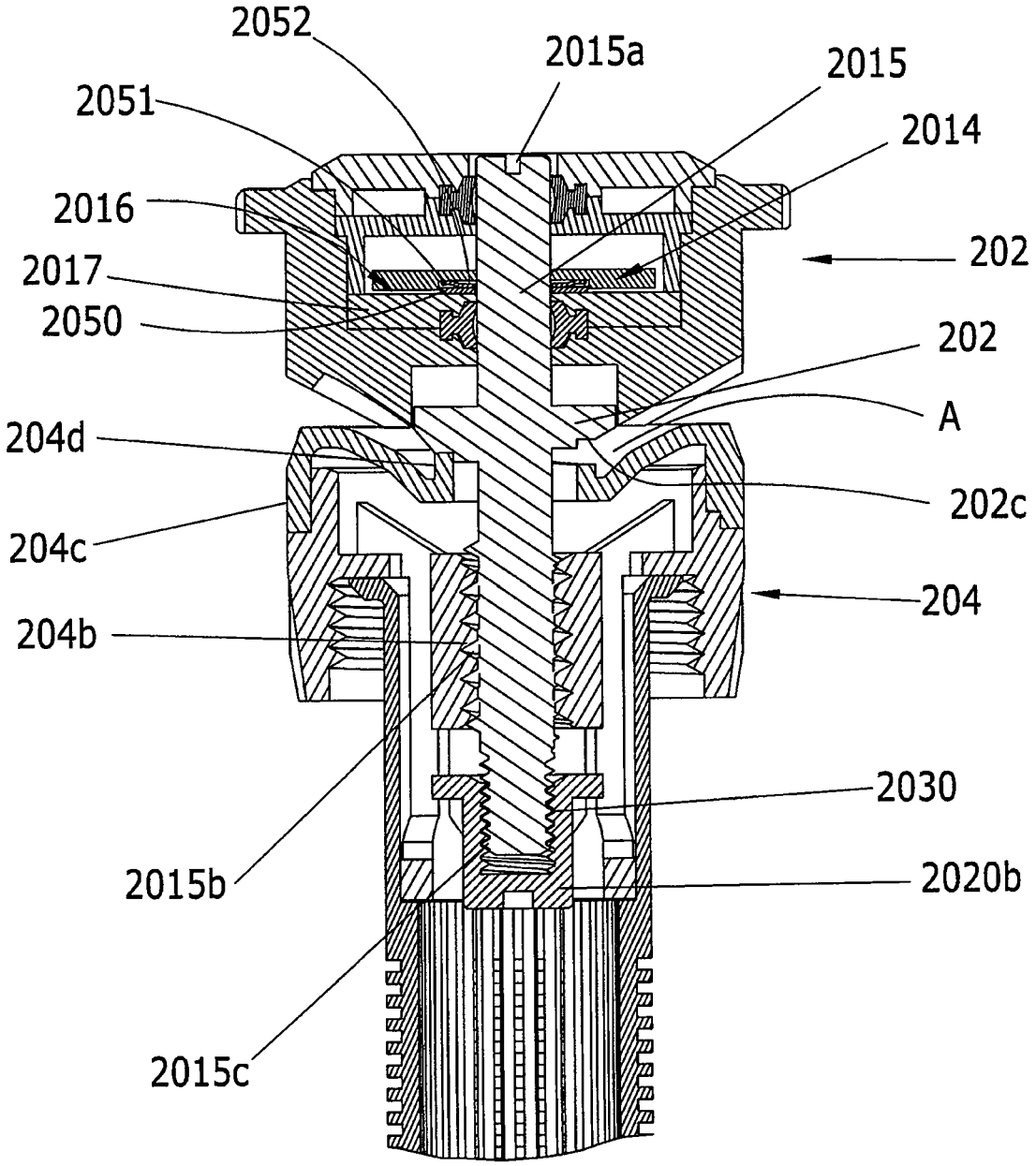
FIG. 48 shows a cross-section of a sprinkler nozzle assembly such as that shown in FIG. 25 with a disc shaped damping rotor and including a damping speed compensation wave washer spring to allow a damping clearance to be adjusted for arc setting and pressure load changes on the rotating distributor.

FIG. 48 shows a cross-section view of a sprinkler nozzle assembly such as that shown in FIG. 25 with a disc shaped speed damping rotor 2014. The underside of the disc shape rotor 2014 has a small cavity 2052 with a wave washer spring 2051 housed in the cavity and in an expanded axially downward condition pressing against a thrust and minimum spacer washer 2050.

Because of wave washer 2051 holding the distributor housing 202 axially downward against the upward force of the water exiting the arc settable arcuate slot at A the viscous film thickness at 2016 between the distributor housing part 2017 and the viscous speed damping stationary damping disc 2014 is wider than the damping slot width at 2016 would have been if the distributor housing part 2017 was riding on the minimum spacing washer 2050 as shown in the basic configuration FIG. 25.

The more open the distance between the stationary viscous damping disc and the housing part 2017, the less speed damping is provided and the rotational speed of the stream rotor distributor 202 is allowed to be faster for a lesser flow of water onto the distributor spiral surface at the smaller adjust arc of coverage settings than it would have been if it were operating at the closer clearance for all of the arc of coverage settings. This automatic adjustment of the viscous speed damping for flow rate or pressure is felt to be unique.

Figure 49:
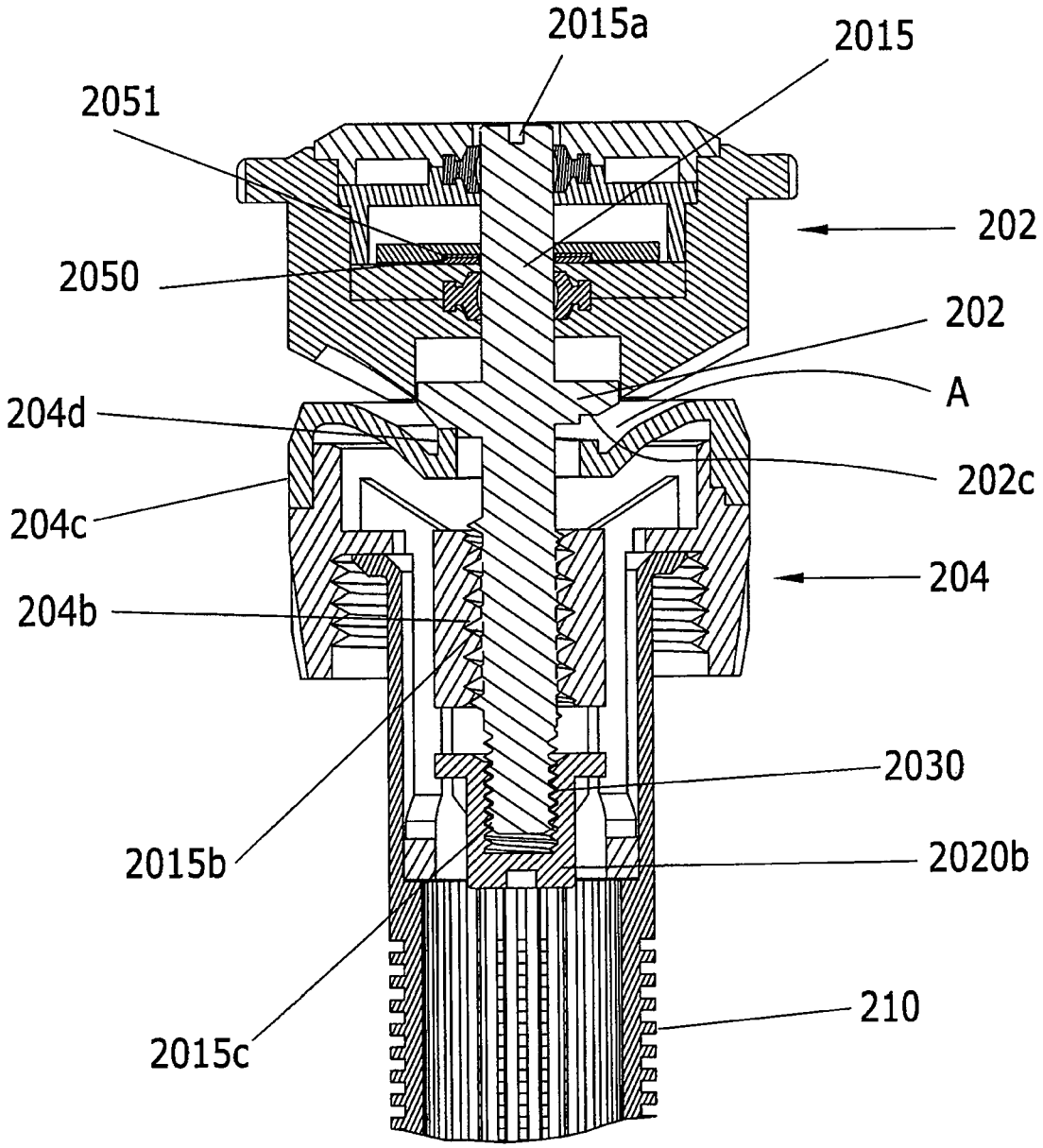
FIG. 49 shows a cross section of the sprinkler nozzle assembly of FIG. 48 in a fully open position and with the wave spring compressed for minimum running clearance for maximum viscous speed damping.

FIG. 49 is the same as FIG. 48 except that the wave washer 2051 is shown compressed due to the additional flow pressure force axially upward onto the rotating distributor 202 due to the arc settable arc of coverage valve open at A being open for a longer arcuate length for an adjusted large arc of coverage, or due to high inlet pressure to the sprinkler nozzle assembly. The result is increased flow and flow pressure upward and then outwardly through the spiral groove on the underside of the stream rotor distributor 202. The increased flow tends to encourage faster rotation of the distributor, however, this faster rotation is prevented since the viscous speed damping clearance is reduced by the compression of the wave washer 2051 under the increased pressure.

Figure 50:
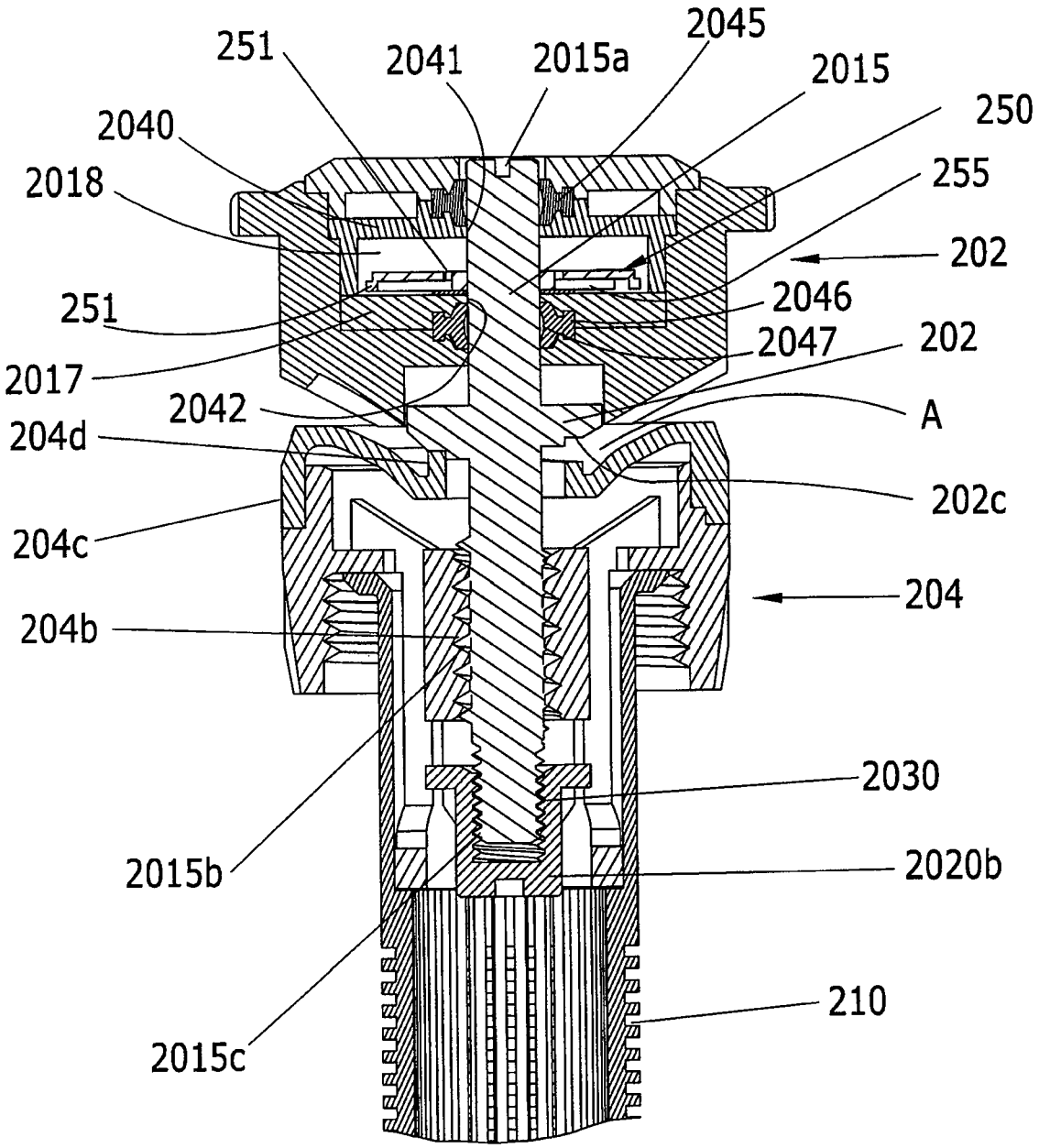
FIG. 50 shows a cross-section of the sprinkler nozzle assembly of FIG. 25 with a different configuration of the viscous damping rotor to provide pumping speed damping in addition to viscous shear damping for rotor speed control.

FIG. 50 shows a cross-section of the sprinkler nozzle assembly of FIG. 25 with a different configuration of viscous damping disc that provides pumping speed damping of a viscous fluid which will generate exponential increase in viscous speed damping force as the distributor speed tries to increase as the flow on the spiral grooves of the distributor 202 increases due to changes in the adjustable arc setting. This effect is due to the build up of work effect due to pump action of the underside of the stationary rotor disc 250 which is fixed on the shaft 2015 and the moving surface of the distributor inner part 2017 surface.

Figure 51:
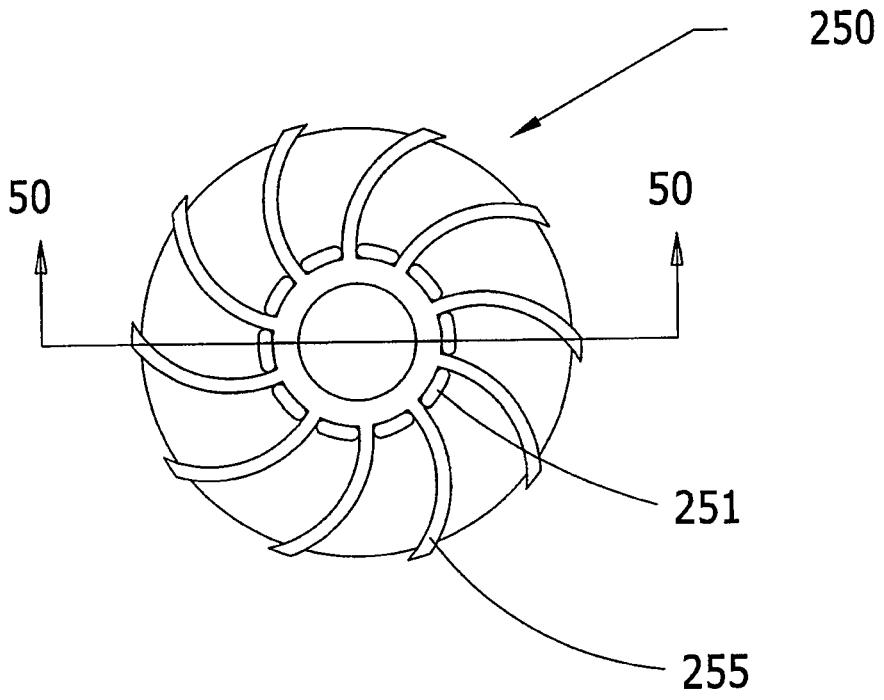
FIG. 51 shows a bottom view of the viscous damping disc rotor showing the pumping vanes and viscous fluid recirculation holes.

The viscous fluid or grease in the speed damping cavity 2018 is collected by the vanes 255 on the underside of the damping disc 250 as shown in FIG. 50. The underside of the damping disc 250 is shown in FIG. 51 in detail. Due to their spiral shape, the viscous fluid (oil or grease) wants to move towards the center for the clockwise rotation of the distributor 202 as viewed from the top of the distributor 202. This causes shear of the viscous fluid over the close clearance of the disc vanes 255 and the plate 2017, but also causes the fluid in the viscous cavity 2018 around the outside inner circumference of the cavity 2018 to be collected by vanes 255 and pulled under the disc 250 and pushed toward the center of the disc 250 where it must pass up through recirculation holes 251 through the disc for additional viscous shear and then can flow up into the viscous damping cavity 2018 area above the disc 250 to be re-circulated again to the outside circumference.

As shown in FIG. 50 the upper cover of the viscous cavity 2018 is formed by plate 2040 which with its center hole 2041 forms an upper bear plate to allow the distributor housing 202 to rotate easily with a minimum of friction in combination with the lower cavity plate 2017 and bearing hole 2042. The viscous cavity seals 2045 and 2046 have their inner rubbing surface adjacent to the shaft 2015 hollowed out as shown to reduce their rubbing friction. The stream rotor distributor 202 requires very little force against its underside spiral grooves to make it turn because of its low friction upper and lower bearing plates 2017 and 2040 and special damping viscous cavity seals 2045 and 2046.

The viscous damping is desired to keep the rotational speed of the stream rotor distributor at less than 1-10 revolutions per minute so that the flow streams can travel 15 to 30 feet, for example.

Figure 52:
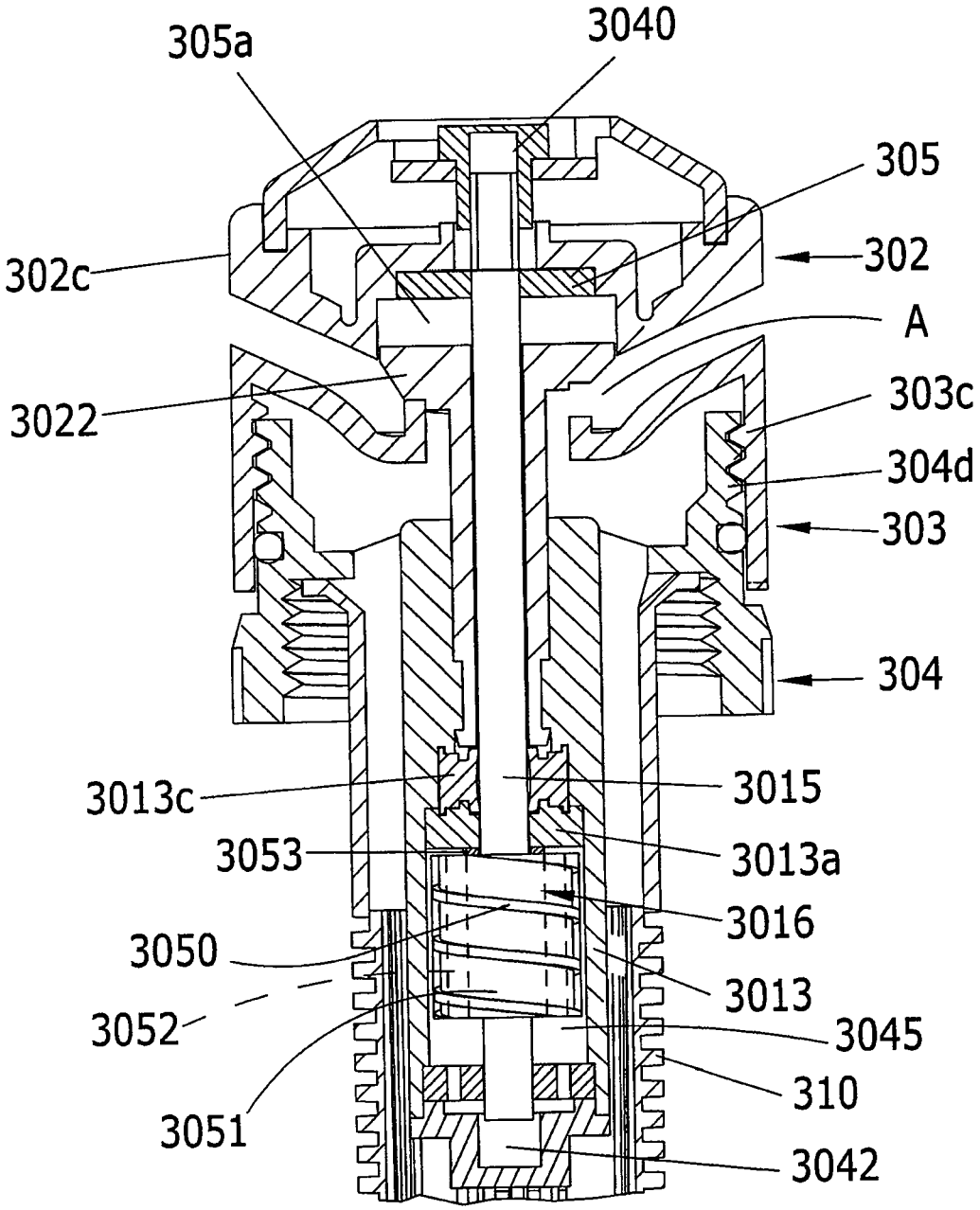
FIG. 52 shows a cross-section of a sprinkler nozzle assembly such as that in FIG. 35 with a viscous pumping speed damping cylindrical configuration rotor showing the spiral pumping vanes and recirculation holes.

FIG. 52 shows a cross-section of a sprinkler nozzle assembly such as that illustrated in FIG. 35, with a viscous pumping damping cylindrical configuration spiral pumping rotor 3016 showing the spiral pumping vanes 3050 and re-circulation holes 3052 up through the center of the rotor 3016.

In this configuration as the stream rotor distributor 302 is rotated clockwise by the high pressure water from the arcuate adjustable valve opening at A against its spiral grooves on its underside and rotates shaft 3015 which the pumping rotor 3016 is press fitted onto. This causes the spirals 3050 to collect the viscous liquid in the viscous speed damping cavity 3045 and pump it downwardly on an Archimedes spiral pump principle. The viscous fluid is sheared and captured and pumped downwardly in the viscous damping chamber 3045. It then must re-circulate back up the re-circulator holes 3052 to the top where it is then recaptured by the helical vanes 3050 around the outside of the damping rotor 3016. The thrust and clearance washer 3053 can be varied in thickness to determine the flow restriction at the top of the rotors flow re-circulation holes 3052. This causes the force necessary to rotate the stream rotor distributor 302 to increase exponentially rather than just linearly as for normal shear. The normal shear force increases linearly, thus double the rotational force doubles the speed. Whereas when it goes up exponentially, for example, when you double the force, the speed only increases by about 40% or about 1.4 times what was at half the force.

Figure 53:
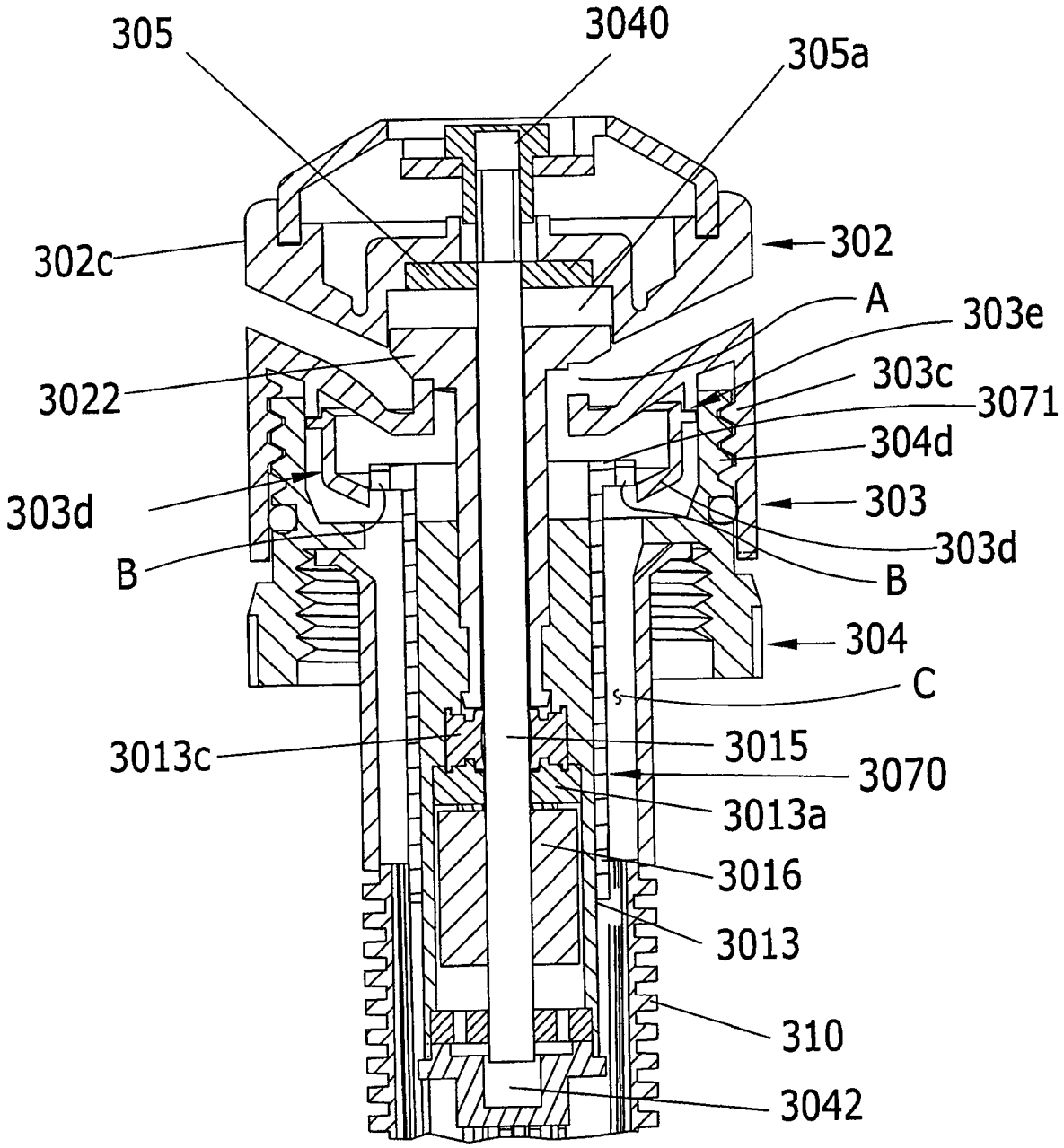
FIG. 53 shows a cross section of the nozzle assembly of FIG. 35 with an upstream flow restrictor for establishing a different range of coverage or precipitation rate.
Figure 54:
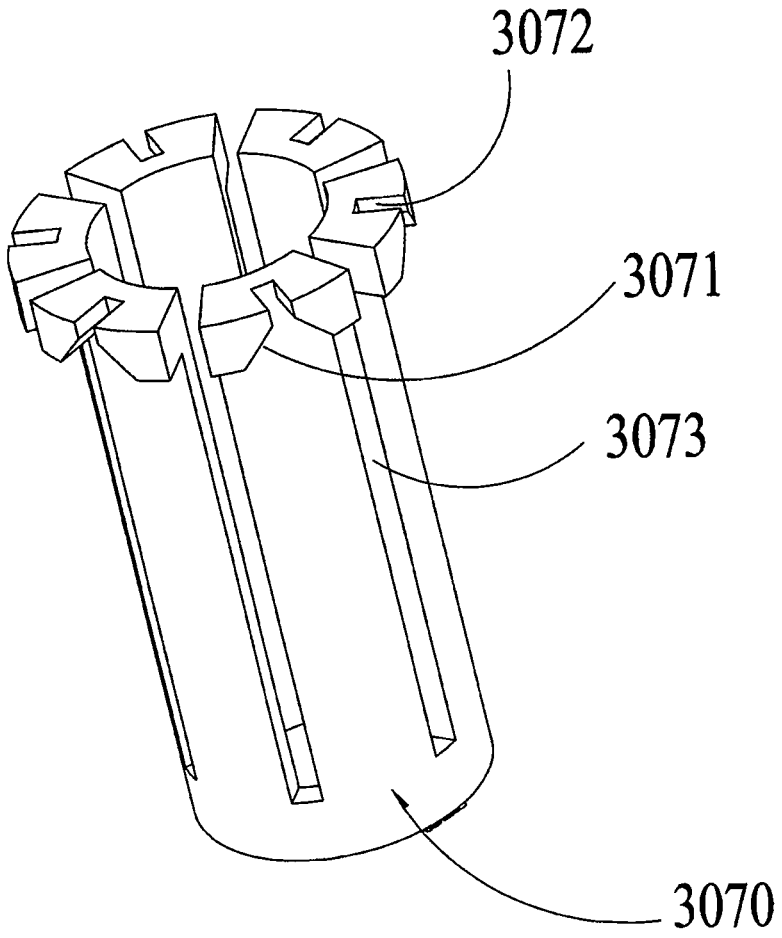
FIG. 54 shows an insertable upstream flow restrictor for establishing a different range and flow rate.

FIG. 53 shows a cross-section of the nozzle assembly of FIG. 35 with an upstream flow restrictor 3070 for establishing a different range of coverage. FIG. 54 shows the insertable upstream flow restrictor 3050 for a particular range of coverage removed from the nozzle assembly.

The restrictor 3070 operates on the same principle as the one discussed above with reference to FIGS. 2 and 2A except that in this nozzle assembly configuration, the arc of coverage ring 303 moves downwardly as the arcuate adjustable valve length of opening is increased at A as illustrated in FIG. 53. Because of this, the upstream proportional throttling valve at B FIG. 53 between 3071 and 303*d* must open as the arc set adjustment ring moves downwardly proportional to the increases in length of the arc set slot at whose flow rate increases linearly with the arc of coverage increase.

Part 303*d* can be sonic welded on to the inside circumference of arc set ring 303*c* at 303*e* as shown in FIG. 53. The upstream proportional adjustable flow area B is shown at B and is fed by flow around the outside of the flow restrictor insert 3070 at C. Thus flow enters the nozzle assembly through filter 310 flows up around the flow restrictor at C is proportionally pressure throttled to provide a reduced pressure to arc of coverage settable arcuate valve flow area at A. This reduced flow pressure at A provides for a lesser range of coverage and a lesser flow rate through valving area A to maintain matched precipitation throughout the fully arc settable range of coverage. The exact range of coverage can be additionally adjusted by the stream elevation exit angle adjustment screw 3040 which causes the flexible elastomeric distributor rotor outer circumference to be deflected down or up.

The above description is meant to describe exemplary embodiments only, and nothing therein should be construed to limit the claim coverage of any patents maturing from this application.

What is claimed is:

1. A viscous brake assembly for use in a sprinkler head nozzle assembly with a rotating distributor to limit the speed of the rotating distributor, the viscous brake assembly comprising:

a viscous braking chamber filled with a viscous liquid, the viscous braking chamber including at least one seal to prevent entry or exit of the viscous liquid such that all of the viscous liquid remains in the viscous braking chamber;

a shaft extending through the viscous braking chamber and attached to a braking disc such that the distributor rotates relative to the shaft and braking disc;

the braking disc formed on the shaft and located in the viscous braking chamber, the braking disc including at least one vane formed on a surface thereof to direct viscous liquid radially inward toward a center of the braking disc as the distributor rotates, wherein the center of the braking disc coincides with an axis of rotation of the distributor.

2. The viscous brake assembly of claim 1, wherein the braking chamber includes a top plate with a first opening formed therein for the shaft to pass through the braking chamber.

3. The viscous brake assembly of claim 2, wherein the viscous braking chamber includes a bottom plate with a second opening formed therein for the shaft to pass through the braking chamber and wherein the braking disc is positioned in the viscous braking chamber closer to the bottom plate than the top plate such that resistance of the viscous liquid between the braking disc and the bottom plate to the rotation of the distributor is a primary source of braking force of the viscous brake assembly.

4. The viscous brake assembly of claim 3, wherein a flow of the viscous liquid toward the shaft increases the braking force of the viscous brake assembly.

5. The viscous brake assembly of claim 4, wherein the viscous braking chamber further comprises a top seal positioned in the first opening in the top plate and operable to prevent the viscous fluid from leaking out of the viscous braking chamber while allowing for rotation of the distributor on the shaft.

6. The viscous brake assembly of claim 5, wherein the viscous braking chamber further comprises a bottom seal positioned in the second opening in the bottom plate and operable to prevent the viscous fluid from leaking out of the viscous braking chamber while allowing for rotation of the distributor on the shaft.

* * * * *